US012753934B2

(12) United States Patent
Kim et al.

(10) Patent No.: US 12,753,934 B2
(45) Date of Patent: Oct. 6, 2026

(54) OUTDOOR UNIT OF AIR CONDITIONER

(71) Applicant: SAMSUNG ELECTRONICS CO., LTD., Suwon-si (KR)

(72) Inventors: Jungwon Kim, Suwon-si (KR); Jungho Yu, Suwon-si (KR); Hyeongju Kim, Suwon-si (KR); Woong Sun, Suwon-si (KR); Kwangnam Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 139 days.

(21) Appl. No.: 18/768,480

(22) Filed: Jul. 10, 2024

(65) Prior Publication Data

US 2025/0093051 A1 Mar. 20, 2025

Related U.S. Application Data

(63) Continuation of application No. PCT/KR2024/009048, filed on Jun. 28, 2024.

(30) Foreign Application Priority Data

Sep. 15, 2023 (KR) ..... 10-2023-0123498

(51) Int. Cl.
*F24F 1/24* (2011.01)
*F24F 13/02* (2006.01)
*F24F 13/20* (2006.01)

(52) U.S. Cl.
CPC ..... *F24F 1/24* (2013.01); *F24F 13/02* (2013.01); *F24F 13/20* (2013.01); *F24F 2013/207* (2013.01)

(58) Field of Classification Search
CPC .... F24F 1/24; F24F 13/02; F24F 13/20; F24F 2013/027
See application file for complete search history.

(56) References Cited

U.S. PATENT DOCUMENTS 10,569,617 B2 2/2020 Lim et al.
2021/0055007 A1* 2/2021 Yaji ..... F24F 1/56
(Continued)

FOREIGN PATENT DOCUMENTS

CN 107726474 2/2021
CN 217540913 10/2022
(Continued)

OTHER PUBLICATIONS

Search Report and Written Opinion dated Oct. 30, 2024 issued in International Patent Application No. PCT/KR2024/009048.

*Primary Examiner* — Marc E Norman
(74) *Attorney, Agent, or Firm* — Nixon & Vanderhye P.C.

(57) ABSTRACT

An outdoor unit of the air conditioner includes: a heat exchange room, a machine room, a partition, a control box accommodating a PCB in the machine room, a heat sink discharging heat from the PCB, and a duct discharging heat from the heat sink to the heat exchange room. The duct includes a duct inlet introducing air, a duct outlet discharging air to the heat exchange room, a first flow path extending from the duct inlet in a first direction along a first part of the heat sink, and a second flow path connecting the first flow path to the duct outlet, in which a second part of the heat sink which extends from the first part in the first direction, is positioned. A width of the second flow path in a second direction is greater than a width of the first flow path in the second direction.

20 Claims, 18 Drawing Sheets

(56) References Cited

U.S. PATENT DOCUMENTS

| | | | | |
|---|---|---|---|---|
| 2021/0071882 | A1* | 3/2021 | Devrath | F24F 1/50 |
| 2024/0369255 | A1* | 11/2024 | Tobbe | F24F 13/20 |
| 2025/0020343 | A1* | 1/2025 | Sun | F24F 1/22 |
| 2025/0102161 | A1* | 3/2025 | Park | F24F 1/56 |

FOREIGN PATENT DOCUMENTS

| | | | |
|---|---|---|---|
| JP | 6-281204 | | 10/1994 |
| JP | H08121818 | A | 5/1996 |
| JP | H1026372 | A | 1/1998 |
| JP | 2009299907 | A | 12/2009 |
| JP | 2010144989 | A | 7/2010 |
| JP | 2010261601 | A | 11/2010 |
| JP | 2011064339 | A | 3/2011 |
| JP | 6896140 | | 6/2021 |
| KR | 0120739 | Y1 | 4/1998 |
| KR | 10-0600749 | | 7/2006 |
| KR | 20090097630 | A | 9/2009 |
| KR | 101293228 | B1 | 8/2013 |
| KR | 10-1457692 | | 11/2014 |
| KR | 10-2527577 | | 4/2023 |
| KR | 10-2550794 | | 7/2023 |

* cited by examiner

FIG. 17

| | DUCT SHAPE EXAMPLE#1 | DUCT SHAPE EXAMPLE#2 | DUCT SHAPE EXAMPLE#3 |
|---|---|---|---|
| T1 | 86.1℃ | 79.3℃ | 76.6℃ |
| T2 | 85.0℃ | 78.2℃ | 75.1℃ |
| T3 | 76.4℃ | 80.8℃ | 77.1℃ |

OUTDOOR UNIT OF AIR CONDITIONER

CROSS-REFERENCE TO RELATED APPLICATIONS

This application is a continuation of International Application No. PCT/KR2024/009048 designating the United States, filed on Jun. 28, 2024, in the Korean Intellectual Property Receiving Office and claiming priority to Korean Patent Application No. 10-2023-0123498, filed on Sep. 15, 2023, in the Korean Intellectual Property Office, the disclosures of each of which are incorporated by reference herein in their entireties.

BACKGROUND

Field

The disclosure relates to an outdoor unit of an air conditioner.

Description of Related Art

An air conditioner is an apparatus for adjusting temperature, humidity, air current, and distribution to conditions suitable for human activities using a cooling cycle. Main components of the cooling cycle include a compressor, a condenser, an evaporator, and a blow fan.

Air conditioners can be classified into a split type air conditioner in which an indoor unit is separated from an outdoor unit, and a window type air conditioner in which an indoor unit and an outdoor unit are installed together in a single cabinet.

The outdoor unit of the split type air conditioner includes an outdoor heat exchanger for performing heat exchange with outside air, a compressor for compressing refrigerants, an expansion valve unit for decompressing refrigerants, and a blow fan for generating a flow of air. The outdoor unit of the air conditioner includes a housing accommodating the outdoor heat exchanger, the expansion valve unit, the compressor, and the blow fan. Also, a control box where a printed circuit board assembly for controlling the air conditioner is accommodated is installed inside the housing.

SUMMARY

Embodiments of the disclosure provide an outdoor unit of an air conditioner with an improved structure for improving an access to a control box.

Embodiments of the disclosure provide an outdoor unit of an air conditioner with an improved structure for improving airtightness of a control box.

Embodiments of the disclosure provide an outdoor unit of an air conditioner with an improved structure for improving heat dissipation efficiency.

Embodiments of the disclosure provide an outdoor unit of an air conditioner with an improved structure for improving internal space efficiency of a product and enabling miniaturization of the product.

Technical problems to be achieved by the present specification are not limited to the above-mentioned technical problems, and other technical problems not mentioned will be clearly understood by those skilled in the art to which the disclosure belongs from the following description.

An outdoor unit of an air conditioner according to an example embodiment of the disclosure may include: a housing including a heat exchange room and a machine room, a partition configured to partition the heat exchange room from the machine room and including a partition opening, a fan positioned in the heat exchange room, a control box positioned in the machine room and configured to accommodate a printed circuit board, a heat sink configured to discharge heat generated in the printed circuit board to outside of the control box and extending along a first direction, and a duct configured to discharge heat transferred from the heat sink to the heat exchange room. At least a part of the heat sink may be positioned inside the duct. The duct may include a duct inlet configured to introduce air into inside of the duct, a duct outlet connected to the partition opening and configured to discharge air to the heat exchange room, a first flow path extending from the duct inlet in the first direction along a first part of the heat sink, the first part being adjacent to the duct inlet, and a second flow path connecting the first flow path to the duct outlet, wherein a second part of the heat sink, the second part extending from the first part in the first direction, is positioned in the second flow path. A width of the second flow path in a second direction different from the first direction may be greater than a width of the first flow path in the second direction.

An outdoor unit of an air conditioner according to an example embodiment of the disclosure may include: a heat exchange room in which a heat exchanger is positioned, a machine room partitioned from the heat exchange room, a control box positioned in the machine room and configured to accommodate electronic components, a heat sink installed in the control box, and a duct, wherein the duct may include a duct inlet connected to the machine room, a duct outlet connected to the heat exchange room, and a duct flow path positioned between the duct inlet and the duct outlet and passing through the heat sink. The duct flow path may include a first flow path extending from the duct inlet in a first direction and passing through a part of the heat sink adjacent to the duct inlet, and a second flow path positioned in the first direction with respect to the first flow path and passing through another part of the heat sink. A width of the second flow path in a second direction different from the first direction may be greater than a width of the first flow path in the second direction, and the second flow path may extend toward the duct outlet along a third direction different from the first direction and the second direction.

An outdoor unit of an air conditioner according to an example embodiment of the disclosure may include: a housing including a heat exchange room and a machine room, a partition partitioning the heat exchange room from the machine room, a fan positioned in the heat exchange room, a control box positioned in the machine room and configured to accommodate a printed circuit board, a plurality of heat transfer plates extending in a first direction from one side adjacent to the printed circuit board and arranged to be spaced apart from each other in a second direction different from the first direction, and a duct positioned in the machine room and connected to the heat exchange room through the partition. The duct may include a duct inlet through which air is configured to flow into inside of the duct, a duct outlet connected to the partition and configured to discharge air to the heat exchange room, and a duct flow path passing through the plurality of heat transfer plates between the duct inlet and the duct outlet. The duct flow path may include a first flow path extending from the duct inlet in a third direction different from the first direction and the second direction, along a part of the plurality of heat transfer plates, adjacent to the duct inlet, and a second flow path extending along the second direction such that air from the plurality of heat transfer plates is configured to flow toward the duct outlet.

BRIEF DESCRIPTION OF THE DRAWINGS

The above and other aspects, features and advantages of certain embodiments of the present disclosure will be more apparent from the following detailed description, taken in conjunction with the accompanying drawings, in which:

FIG. 17 is a table showing experimental results obtained by measuring temperature of electronic components shown in FIG. 16 according to various embodiments.

DETAILED DESCRIPTION

Figure 1:
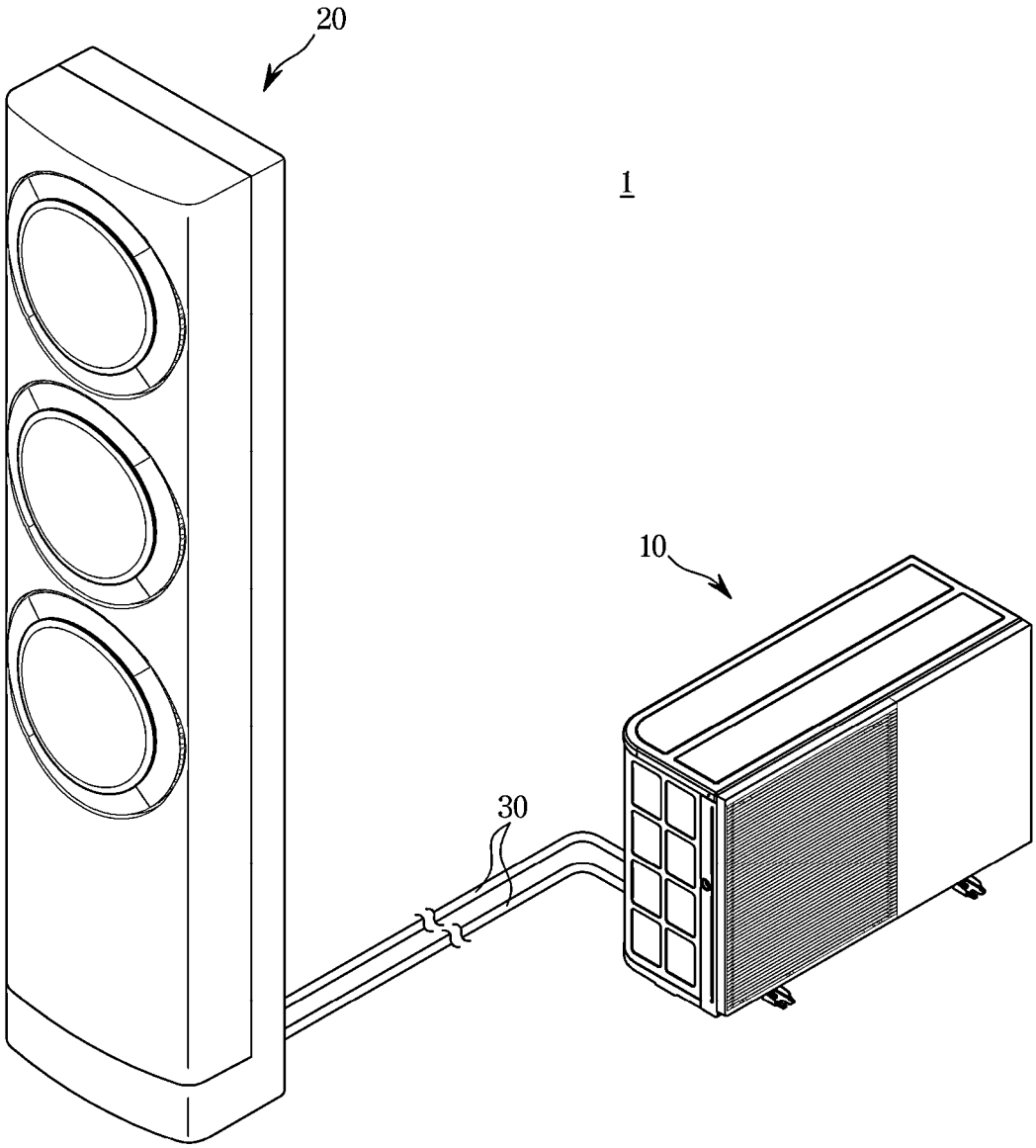
FIG. 1 is a perspective view illustrating an example air conditioner according to various embodiments.

Various embodiments of the present disclosure and terms used therein are not intended to limit the technical features described in this disclosure to specific embodiments, and should be understood to include various modifications, equivalents, or substitutes of the corresponding embodiments.

In connection with the description of the drawings, similar reference numerals may be used for similar or related components.

The singular form of a noun corresponding to an item may include one or a plurality of the items unless clearly indicated otherwise in a related context.

In this disclosure, phrases, such as "A or B", "at least one of A and B", "at least one of A or B," "A, B or C," "at least one of A, B and C," and "at least one of A, B, or C", may include any one or all possible combinations of items listed together in the corresponding phrase among the phrases.

As used herein, the term "and/or" includes any and all combinations of one or more of associated listed items.

Terms such as "first", "second", or "$1^{st}$" or "$2^{nd}$" may be used simply to distinguish a component from other components, without limiting the component in other aspects (e.g., importance or order).

A certain (e.g., a first) component is referred to as "coupled" or "connected" with or without the terms "functionally" or "communicatively" to another (e.g., second) component. When mentioned, any of the certain component can be connected to the other component directly (e.g., by wire), wirelessly, or via a third component.

It will be understood that when the terms "includes," "comprises," "including," and/or "comprising," used in this disclosure, specify the presence of stated features, figures, steps, operations, components, members, or combinations thereof, but do not preclude the presence or addition of one or more other features, figures, steps, operations, components, members, or combinations thereof.

It will be understood that when a certain component is referred to as being "connected to", "coupled to", "supported by" or "in contact with" another component, it can be directly or indirectly connected to, coupled to, supported by, or in contact with the other component. When a component is indirectly connected to, coupled to, supported by, or in contact with another component, it may be connected to, coupled to, supported by, or in contact with the other component through a third component.

It will also be understood that when a certain component is referred to as being "on" or "over" another component, it can be directly on the other component or intervening components may also be present.

An air conditioner according to various embodiments may include an apparatus for performing at least one of functions of air purifying, ventilation, humidity adjustment, cooling, heating, etc. in a space (hereinafter, referred to as 'indoor') to be air-conditioned.

According to an embodiment, the air conditioner may include a heat pump for performing a cooling function or a heating function. The heat pump may include a freezing cycle in which a refrigerant is circulated along a compressor, a first heat exchanger, an expander, and a second heat exchanger. Components of the heat pump may be installed in a single housing forming an appearance of the air conditioner, and a window-type air conditioner or a portable type air conditioner may correspond to the air conditioner. Some components of the heat pump may be divided and installed in a plurality of housings forming a single air conditioner, and a wall-mounted type air conditioner, a stand-type air conditioner, and a system air conditioner may correspond to the air conditioner.

The air conditioner including the plurality of housings may include at least one outdoor unit installed outdoors and at least one indoor unit installed indoors. For example, the air conditioner may connect an outdoor unit to an indoor unit through a refrigerant pipe. For example, the air conditioner may connect an outdoor unit to two or more indoor units through refrigerant pipes. For example, the air conditioner may connect two or more outdoor units to two or more indoor units through a plurality of refrigerant pipes.

The outdoor unit may be electrically connected to the indoor unit. For example, information (or a command) for controlling the air conditioner may be input through an input interface provided in the outdoor unit or the indoor unit, and the outdoor unit and the indoor unit may operate simultaneously or sequentially in response to a user input.

The air conditioner may include an outdoor heat exchanger provided in the outdoor unit, an indoor heat exchanger provided in the indoor unit, and the refrigerant pipe connecting the outdoor heat exchanger to the indoor heat exchanger.

The outdoor heat exchanger may perform heat exchange between a refrigerant and outside air using a phase change (for example, evaporation or condensation) of the refrigerant. For example, while the refrigerant is condensed in the indoor heat exchanger, the refrigerant may emit heat to outside air, and, while the refrigerant flowing through the outdoor heat exchanger is evaporated, the refrigerant may absorb heat from outside air.

The indoor unit may be installed indoors. For example, the indoor unit may be classified into a ceiling type indoor unit, a stand type indoor unit, and a wall-mounted type indoor unit according to arrangement methods. For example, the ceiling type indoor unit may be classified into a four-way type indoor unit, a one-way type indoor unit, and a duct-type indoor unit according to methods by which air is discharged.

The indoor heat exchanger may perform heat exchange between a refrigerant and indoor air using a phase change (for example, evaporation or condensation) of the refrigerant. For example, while the refrigerant is evaporated in the indoor unit, the refrigerant may absorb heat from indoor air, and by blowing indoor air cooled by passing through the cooled indoor heat exchanger, an indoor space may be cooled. While the refrigerant is condensed in the indoor heat exchanger, the refrigerant may emit heat to indoor air, and by blowing indoor air heated by passing through the high-temperature indoor heat exchanger, the indoor space may be heated.

For example, the air conditioner may perform a cooling or heating function through the phase-change process of the refrigerant that circulates between the outdoor heat exchanger and the indoor heat exchanger, and for the circulation of the refrigerant, the air conditioner may include the compressor that compresses the refrigerant. The compressor may intake a refrigerant gas through an inlet and compress the refrigerant gas. The compressor may discharge a high-temperature and high-pressure refrigerant gas through an outlet. The compressor may be installed inside the outdoor unit.

A refrigerant may circulate through the refrigerant pipe in the order of the compressor, the outdoor heat exchanger, the expander, and the indoor heat exchanger or in the order of the compressor, the indoor heat exchanger, the expander, and the outdoor heat exchanger.

For example, in the air conditioner, an outdoor unit may be directly connected to an indoor unit through a refrigerant pipe, and in this case, a refrigerant may circulate between the outdoor unit and the indoor unit through the refrigerant pipe.

For example, in the air conditioner, an outdoor unit may be connected to two or more indoor units through refrigerant pipes, and in this case, a refrigerant may flow to a plurality of indoor units through the refrigerant pipes diverging from the outdoor unit. Refrigerants discharged from the plurality of indoor units may be joined and circulate to the outdoor unit. For example, the plurality of indoor units may be connected in parallel to the outdoor unit through separate refrigerant pipes.

The plurality of indoor units may operate independently according to operation modes set, for example, by a user. For example, a part of the plurality of indoor units may operate in a cooling mode, and simultaneously, another part of the plurality of indoor units may operate in a heating mode. In this case, a refrigerant may enter each of the indoor units in a high or low pressure state selectively along a circulation flow path designated through a flow path switching valve which will be described below, be discharged, and then circulate to the outdoor unit.

For example, in the air conditioner, two or more outdoor units may be connected to two or more indoor units through a plurality of refrigerant pipes, and in this case, refrigerants discharged from a plurality of outdoor units may be joined, flow through a single refrigerant pipe, then diverge at a certain location, and enter a plurality of indoor units.

The plurality of outdoor units may operate or at least some of the plurality of outdoor units may not operate according to a driving load depending on a driving amount of the plurality of indoor units. In this case, the refrigerant may enter the outdoor units that selectively operate through the flow path switching valve, and circulate. The air conditioner may include the expander for lowering pressure of the refrigerant that enters the heat exchanger. For example, the expander may be positioned inside the indoor unit or the outdoor unit or inside both the indoor unit and the outdoor unit.

The expander may lower temperature and pressure of the refrigerant using, for example, a throttling effect. The expander may include an orifice capable of reducing a cross-sectional area of a flow path. The refrigerant passed through the orifice may be lowered in temperature and pressure.

The expander may be implemented as an electronic expansion valve capable of adjusting an opening rate (a ratio of a cross-sectional area of the flow path of the valve in a partially open state with respect to a cross-sectional area of the flow path of the valve in a fully open state). An amount of a refrigerant passing through the expander may be controlled depending on an opening rate of the electronic expansion valve.

The air conditioner may further include the flow path switching valve positioned on the refrigerant circulation flow path. The flow path switching valve may include, for example, a 4-way valve. The flow path switching valve may set a circulation path of a refrigerant depending on a driving mode (for example, cooling driving or heating driving) of the indoor unit. The flow path switching valve may be connected to the outlet of the compressor.

The air conditioner may include an accumulator. The accumulator may be connected to the inlet of the compressor. A low-temperature and low-pressure refrigerant evaporated from the indoor heat exchanger or the outdoor heat exchanger may enter the accumulator.

While a refrigerant being a mixture of a refrigerant liquid and a refrigerant gas enters the accumulator, the accumulator may separate the refrigerant liquid from the refrigerant gas and provide the refrigerant gas from which the refrigerant liquid has been separated to the compressor.

An outdoor fan may be provided around the outdoor heat exchanger. The outdoor fan may blow outside air to the outdoor heat exchanger to facilitate heat exchange between a refrigerant and outside air.

The outdoor unit of the air conditioner may include at least one sensor. For example, the sensor of the outdoor unit may include an environment sensor. The sensor of the outdoor unit may be positioned inside the outdoor unit or at an arbitrary location outside the outdoor unit. For example, the sensor of the outdoor unit may include a temperature sensor for detecting temperature of air around the outdoor unit, a humidity sensor for detecting humidity of air around the outdoor unit, a refrigerant temperature sensor for detecting refrigerant temperature of a refrigerant pipe passing through the outdoor unit, or a refrigerant pressure sensor for detecting refrigerant pressure of the refrigerant pipe passing through the outdoor unit.

The outdoor unit of the air conditioner may include an outdoor unit communicator. The outdoor unit communicator may include various communication circuitry and receive a control signal from a controller of the indoor unit of the air conditioner, which will be described below. The outdoor unit may control an operation of the compressor, the outdoor heat exchanger, the expander, the flow path switching valve, the accumulator, or the outdoor fan, based on a control signal received through the outdoor unit communicator. The outdoor unit may transmit a sensing value detected by the sensor of the outdoor unit to the controller of the indoor unit through the outdoor unit communicator.

The indoor unit of the air conditioner may include a housing, a blower that circulates air into or out of the housing, and the indoor heat exchanger that exchanges heat with air entered the housing.

The housing may include an inlet. Indoor air may flow into the housing through the inlet.

The indoor unit of the air conditioner may include a filter that filters a foreign material from air flowed into the housing through the inlet.

The housing may include an outlet. Air flowing inside the housing may be discharged to outside of the housing through the outlet.

In the housing of the indoor unit, an airflow guide for guiding a direction of air to be discharged through the outlet may be provided. For example, the airflow guide may include a blade positioned on the outlet. For example, the airflow guide may include an auxiliary fan for adjusting a discharge airflow, although not limited thereto. However, the airflow guide may be omitted.

Inside the housing of the indoor unit, the indoor heat exchanger and the blower may be positioned on a flow path connecting the inlet to the outlet.

The blower may include an indoor fan and a fan motor. For example, the indoor fan may include an axial flow fan, a mixed flow fan, a cross flow fan, and a centrifugal fan.

The indoor heat exchanger may be positioned between the blower and the outlet or between the inlet and the blower. The indoor heat exchanger may absorb heat from air received through the inlet or transfer heat to air received through the inlet. The indoor heat exchanger may include a heat exchange pipe through which a refrigerant flows and a heat exchange fin that is in contact with the heat exchange pipe to increase a heat transfer area.

The indoor unit of the air conditioner may include a drain tray positioned below the indoor heat exchanger to collect condensed water generated in the indoor heat exchanger. Condensed water accommodated in the drain tray may be discharged to the outside through a drain hose. The drain tray may support the indoor heat exchanger.

The indoor unit of the air conditioner may include an input interface. The input interface may include an arbitrary type of user input device including a button, a switch, a touch screen, and/or a touch pad. A user may himself/herself input setting data (for example, desired room temperature, a driving mode setting for cooling/heating/dehumidifying/air cleaning, an outlet selection setting, and/or an air volume setting) through the input interface.

The input interface may also be connected to an external input device. For example, the input interface may be electrically connected to a wired remote controller. The wired remote controller may be installed in a certain location (for example, a part of a wall) of an indoor space. The user may input setting data for an operation of the air conditioner by controlling the wired remote controller. An electrical signal corresponding to the setting data obtained through the wired remote controller may be transmitted to the input interface. Also, the input interface may include an infrared sensor. The user may input setting data for an operation of the air conditioner remotely using a wireless remote controller. The setting data input through the wireless remote controller may be transmitted as an infrared signal to the input interface.

The input interface may include a microphone. A user's voice command may be obtained through the microphone. The microphone may convert the user's voice command into an electrical signal and transfer the converted electrical signal to an indoor unit controller. The indoor unit controller may control components of the air conditioner to execute a function corresponding to the user's voice command. The setting data (for example, desired room temperature, a driving mode setting for cooling/heating/dehumidifying/air cleaning, an outlet selection setting, and/or an air volume setting) obtained through the input interface may be transferred to the indoor unit controller which will be described below. According to an example, setting data obtained through the input interface may be transmitted to an external device, that is, the outdoor unit or a server through an indoor unit communicator which will be described below.

The indoor unit of the air conditioner may include a power module. The power module may be connected to an external power source to supply power to components of the indoor unit.

The indoor unit of the air conditioner may include an indoor unit sensor. The indoor unit sensor may be an environment sensor positioned in an inside or outside space of the housing. For example, the indoor unit sensor may include one or more temperature sensors and/or humidity sensors positioned in a preset space inside or outside the housing of the indoor unit. For example, the indoor unit sensor may include a refrigerant temperature sensor for detecting refrigerant temperature of a refrigerant pipe passing through the indoor unit. For example, the indoor unit sensor may include a refrigerant temperature sensor that detects temperature at each of an entrance, middle part, and/or exit of the refrigerant pipe passing through the indoor heat exchanger.

For example, environment information detected by the indoor unit sensor may be transferred to the indoor unit controller which will be described below or transmitted to the outside through the indoor unit communicator which will be described in greater detail below.

The indoor unit of the air conditioner may include the indoor unit communicator. The indoor unit communicator may include at least one of a short-range communication module or a long-distance communication module. The indoor unit communicator may include at least one antenna for wirelessly communicating with another device. The outdoor unit may include an outdoor unit communicator. The outdoor unit communicator may also include at least one of a short-range communication module or a long-distance communication module.

The short-range wireless communication module may include a Bluetooth communication module, a Bluetooth Low Energy (BLE) communication module, a Near Field Communication (NFC) module, a Wireless Local Area Network (WLAN; WiFi) communication module, a Zigbee communication module, an Infrared Data Association (IrDA) communication module, a Wi-Fi Direct (WFD) communication module, a ultrawideband (UWB) communication module, an Ant+ communication module, a microwave (uWave) communication module, etc., although not limited thereto.

The long-distance wireless communication module may include a communication module that performs various kinds of long-distance communications, and may include a mobile communicator. The mobile communicator may transmit/receive a wireless signal to/from at least one of a base station, an external terminal, or a server on a mobile communication network.

The indoor unit communicator may communicate with an external device, such as a server, a mobile device, another home appliance, etc., through a surrounding Access Point (AP). The AP may connect a Local Area Network (LAN) to which the air conditioner or a user device is connected to a Wide Area Network (WAN) to which a server is connected. The air conditioner or the user device may be connected to the server through the WAN. The indoor unit of the air conditioner may include the indoor unit controller that controls the components of the indoor unit, including the blower, etc. The outdoor unit of the air conditioner may include an outdoor unit controller that controls the components of the outdoor unit, including the compressor, etc. The indoor unit controller may communicate with the outdoor unit controller through the indoor unit communicator and the outdoor unit communicator. The outdoor unit communicator may transmit a control signal generated by the outdoor unit controller to the indoor unit communicator, or transfer a control signal transmitted from the indoor unit communicator to the outdoor unit controller. For example, the outdoor unit and the indoor unit may perform bidirectional communication. The outdoor unit and the indoor unit may transmit and receive various signals generated while the air conditioner operates.

The outdoor unit controller may be electrically connected to the components of the outdoor unit and control operations of the individual components. For example, the outdoor unit controller may adjust a frequency of the compressor, and control the flow path switching valve to switch a circulation direction of a refrigerant. The outdoor unit controller may adjust a rotation speed of the outdoor fan. The outdoor unit controller may generate a control signal for adjusting an opening rate of the expansion valve. A refrigerant may circulate along a refrigerant circulation circuit including the compressor, the flow path switching valve, the outdoor heat exchanger, the expansion valve, and the indoor heat exchanger, under a control by the outdoor unit controller.

Various temperature sensors included in the outdoor unit and the indoor unit may each transmit an electrical signal corresponding to detected temperature to the outdoor unit controller and/or the indoor unit controller. For example, the humidity sensors included in the outdoor unit and the indoor unit may each transmit an electrical signal corresponding to detected humidity to the outdoor unit controller and/or the indoor unit controller.

The indoor unit controller may obtain a user input from a user device including a mobile device, etc. through the indoor unit communicator, or obtain a user input directly through the input interface or through the remote controller. The indoor unit controller may control the components of the indoor unit, including the blower, etc. in response to the received user input. The indoor unit controller may transmit information related to the received user input to the outdoor unit controller of the outdoor unit.

The outdoor unit controller may control the components of the outdoor unit including the compressor, etc. based on the information about the user input, received from the indoor unit. For example, according to reception of a control signal corresponding to a user input of selecting a driving mode, such as cooling driving, heating driving, blowing driving, defrosting driving, or dehumidifying driving, from the indoor unit, the outdoor unit controller may control the components of the outdoor unit to perform an operation of the air conditioner corresponding to the selected driving mode.

Each of the indoor unit controller and the indoor unit controller may include a processor (e.g., at least one processor comprising processing circuitry) and a memory. The indoor unit controller may include at least one first processor and at least one first memory, and the outdoor unit controller may include at least one second processor and at least one second memory.

The memory may memorize/store various information required for operations of the air conditioner. The memory may store instructions, applications, data, and/or programs required for the operations of the air conditioner. For example, the memory may store various programs for cooling driving, heating driving, dehumidifying driving, and/or defrosting driving of the air conditioner. The memory may include a volatile memory, such as Static Random Access Memory (S-RAM) and Dynamic Random Access Memory (D-RAM), for temporarily memorizing data. Also, the memory may include a non-volatile memory, such as Read Only Memory (ROM), Erasable Programmable Read Only Memory (EPROM), and Electrically Erasable Programmable Read Only Memory (EEPROM), for storing data for a long time.

The processor may generate a control signal for controlling the operations of the air conditioner based on the instructions, applications, data, and/or programs stored in the memory. The processor may include a logic circuit and an arithmetic circuit, as hardware. The processor may process data according to a program and/or instruction provided from the memory, and generate a control signal according to the processed result. The memory and processor may be implemented as a single control circuit or a plurality of circuits. The processor according to an embodiment of the disclosure may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

The indoor unit of the air conditioner may include an output interface. The output interface may be electrically connected to the indoor unit controller, and output information related to an operation of the air conditioner under a control by the indoor unit controller. For example, information, such as a driving mode, a direction of wind, an air volume, and temperature, selected by a user input may be output. Also, the output interface may output sensing information and a warning/error message obtained from an indoor unit sensor or an outdoor unit sensor.

The output interface may include a display and a speaker. The speaker, which is a sound system, may output various sounds. The display may display information input by the user or information to be provided to the user, as various graphic elements. For example, operation information of the air conditioner may be displayed as at least one of an image or text. Also, the display may include an indicator that provides specific information. The display may include a Liquid Crystal Display Panel (LCD) panel, a Light Emitting Diode Panel (LED) panel, an Organic Light Emitting Diode (OLED) panel, a micro LED panel, and/or a plurality of LEDs.

Hereinafter, various embodiments of the disclosure will be described in greater detail with reference to the accompanying drawings.

In the following description, the terms "upper", "lower", "front", "rear", etc. are defined based on the drawings, and the shapes and positions of the components are not limited by the terms. For example, referring to FIG. 2, in an outdoor unit 10 of an air conditioner 1 according to an embodiment of the disclosure, a direction that each of an outlet grille 180 and a front cover 190 faces may be defined as a front direction (+X direction), and an opposite direction of the front direction may be defined as a rear direction (−X direction). Also, in the outdoor unit 10 of the air conditioner 1, a vertical direction that a top cover 171 faces may be defined as an upper direction (+Z direction), and an opposite direction of the upper direction may be defined as a lower direction (−Z direction). Also, in the outdoor unit 10 of the air conditioner 1, a direction in which a first side frame 150 is positioned may be defined as a left direction (−Y direction), and an opposite direction of the left direction may be defined as a right direction (+Y direction).

FIG. 1 is a perspective view illustrating an example air conditioner according to various embodiments.

Referring to FIG. 1, the air conditioner 1 according to an embodiment of the disclosure may include an indoor unit 20 that is placed in an indoor space and an outdoor unit 10 that is placed in an outdoor space.

To cool an air-conditioned space to be air-conditioned, the air conditioner 1 may absorb heat inside the air-conditioned space and emit heat outside the air-conditioned space. Also, to heat the air-conditioned space, the air conditioner 1 may absorb heat outside the air-conditioned space and emit heat inside the air-conditioned space.

The outdoor unit 10 may exchange heat with outside air outside the air-conditioned space. The outdoor unit 10 may perform heat exchange between a refrigerant and outside air using a phase change (for example, evaporation or condensation) of the refrigerant. For example, the outdoor unit 10 may discharge heat of a refrigerant to outside air using condensation of the refrigerant. Also, the outdoor unit 10 may absorb heat of outside air into a refrigerant using evaporation of the refrigerant.

In FIG. 1, a single outdoor unit 10 is shown, however, the number of the outdoor unit 10 is not limited to that shown in FIG. 1. For example, the air conditioner 1 may include a plurality of outdoor units.

The outdoor unit 10 may include an outdoor heat exchanger 11 (see FIG. 3) that performs heat exchange with outside air, and a compressor 12 (see FIG. 3) that compresses a refrigerant gas.

A configuration of the outdoor unit 10 will be described in detail, below.

The indoor unit 20 may exchange heat with indoor air inside the air-conditioned space. The indoor unit 20 may perform heat exchange between a refrigerant and indoor air using a phase change (for example, evaporation or condensation) of the refrigerant. For example, the indoor unit 20 may absorb heat of indoor air into a refrigerant using evaporation of the refrigerant to cool the air-conditioned space. The indoor unit 20 may discharge heat of a refrigerant to indoor air using condensation of the refrigerant to heat the air-conditioned space.

The indoor unit 20 may include an indoor heat exchanger that performs heat exchange with indoor air, an indoor blow fan that intakes and blows indoor air to cause the indoor air to pass through the indoor heat exchanger, and an expansion valve unit that decompresses a refrigerant and expands the refrigerant.

In FIG. 1, a single indoor unit 20 is shown, however, the number of the indoor unit 20 is not limited to that shown in FIG. 1. For example, the air conditioner 1 may include a plurality of indoor units. A plurality of different indoor units may be installed in a plurality of different air-conditioned spaces, respectively.

As such, the air conditioner 1 may perform heat exchange between a refrigerant and outside air outside the air-conditioned space, and perform heat exchange between the refrigerant and indoor air inside the air-conditioned space.

In this case, to move heat between the inside and outside of the air-conditioned space, the air conditioner 1 may include a connecting pipe 30 that transfers the refrigerant between the indoor unit 20 and the outdoor unit 10. The connecting pipe 30 may move the refrigerant between the outside and inside of the air-conditioned space. The indoor unit 20 may be connected to the outdoor unit 10 through the connecting pipe 30 that transfers the refrigerant.

The above-described air conditioner 1 may be an example of an air conditioner to which an outdoor unit of an air conditioner according to the disclosure is applicable, and the disclosure is not limited to the air conditioner 1. The air conditioner to which the outdoor unit of the air conditioner according to the disclosure is applicable, and components, such as an indoor unit, a connecting pipe, etc., included in the air conditioner, may be various.

Hereinafter, the outdoor unit 10 of the air conditioner 1 according to an embodiment of the disclosure will be described in greater detail with reference to FIGS. 2 to 18.

Figure 2:
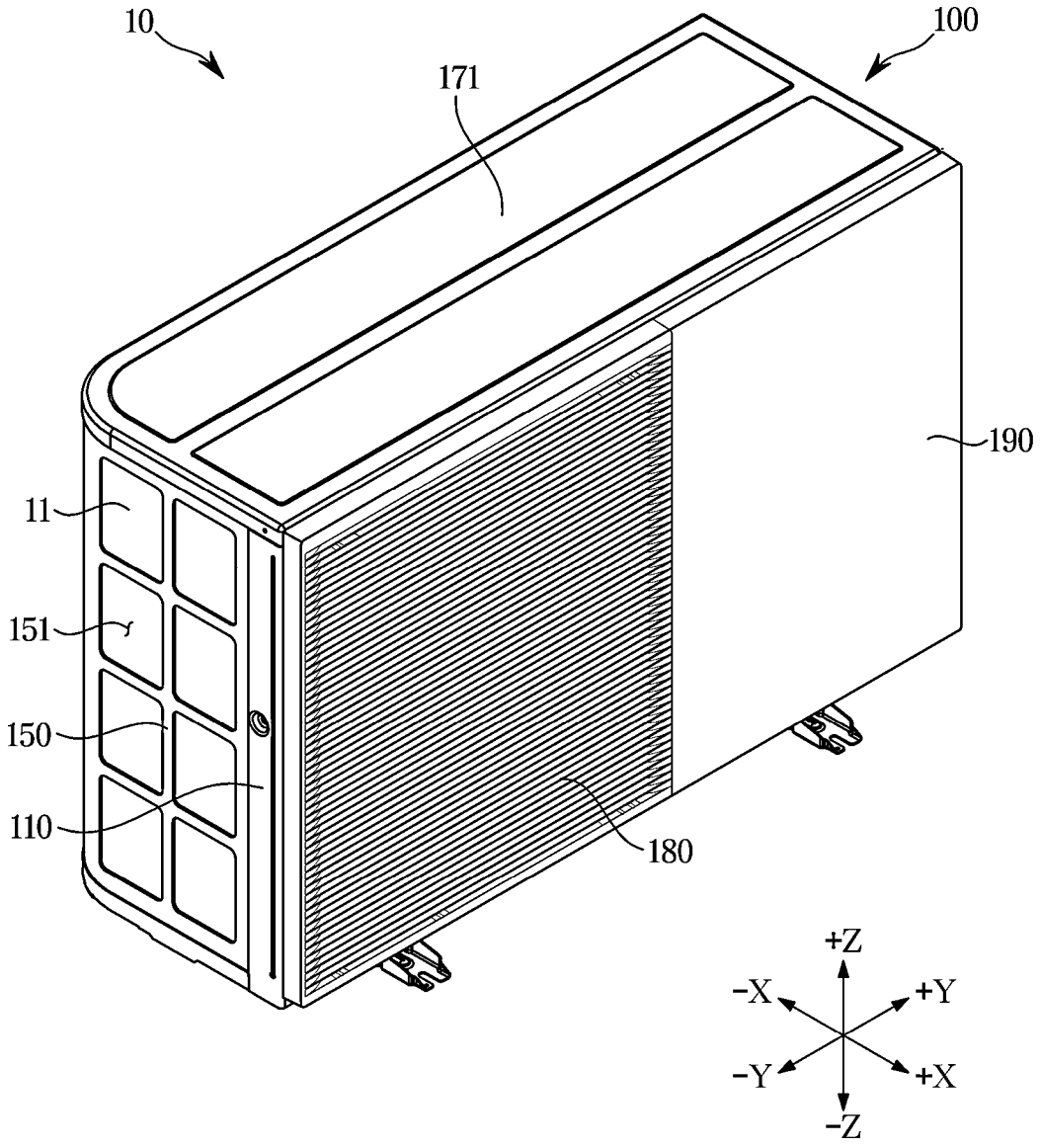
FIG. 2 is a perspective view illustrating an example outdoor unit of an air conditioner according to various embodiments.
Figure 3:
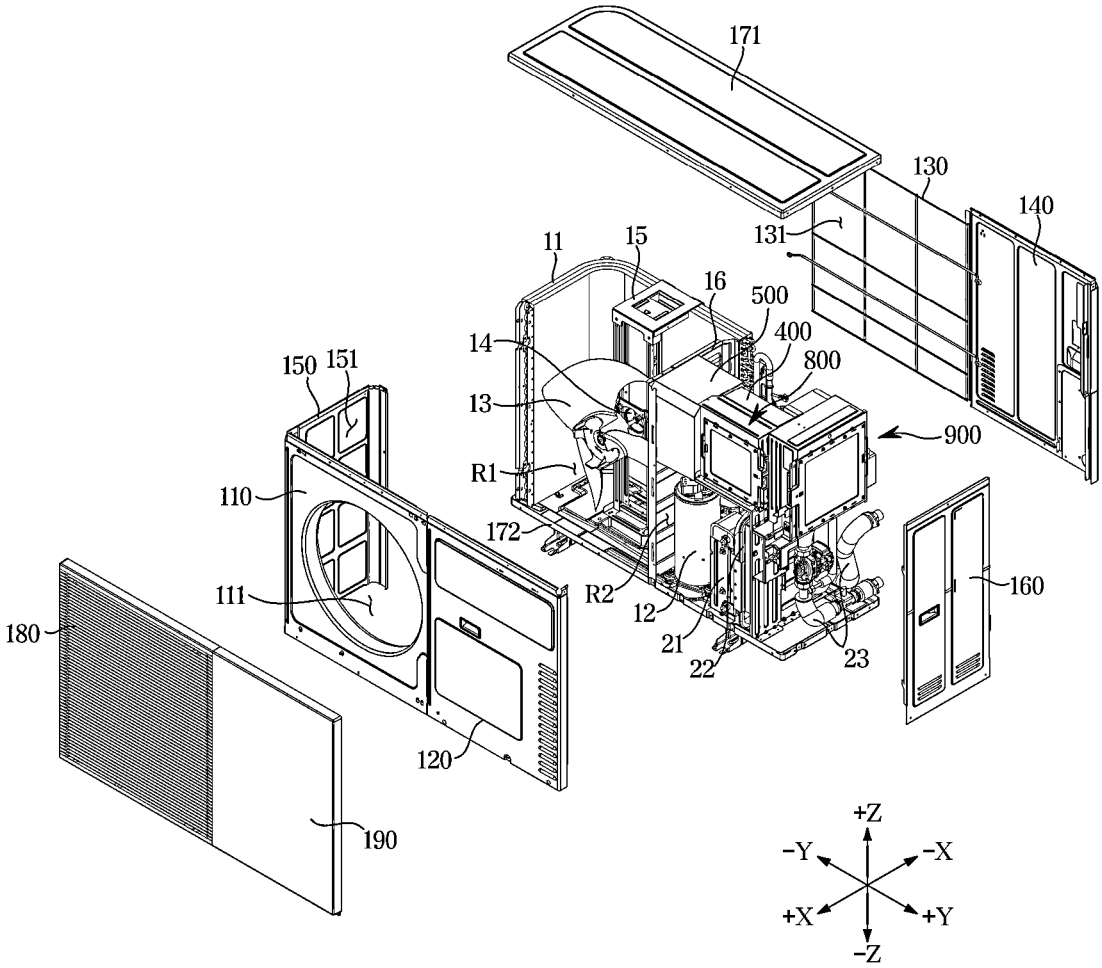
FIG. 3 is an exploded perspective view of an outdoor unit of an air conditioner according to various embodiments.

FIG. 2 is a perspective view illustrating an example outdoor unit of an air conditioner according to various embodiments. FIG. 3 is an exploded perspective view of an outdoor unit of an air conditioner according to various embodiments.

Referring to FIGS. 2 and 3, the outdoor unit 10 of the air conditioner 1 according to an embodiment of the disclosure may include the outdoor heat exchanger 11 that performs heat exchange with outside air, the compressor 12 that compresses a refrigerant, an outdoor fan 13 that intakes outside air and blows the outside air to cause the outside air to pass through the outdoor heat exchanger 11, and a housing 100 forming an appearance of the outdoor unit 10.

The housing 100 may form the appearance of the outdoor unit 10. Various components of the outdoor unit 10, such as the outdoor heat exchanger 11, the compressor 12, the outdoor fan 13, control boxes 800 and 900 which will be described below, etc., may be accommodated inside the housing 100.

The housing 100 may include inlets 131 and 151 through which air flows into the housing 100, and an outlet 111 through which air is discharged. According to a rotation of the outdoor fan 13, outside air of the housing 100 may flow into the housing 100 through the inlets 131 and 151, and after the outside air is heat-exchanged in the outdoor heat exchanger 11, the outside air may be discharged to the outside of the housing 100 through the outlet 111.

The outdoor unit 10 may include a heat exchange room R1 formed inside the housing 100. Outside air may flow into the heat exchange room R1, and the air may be again discharged to the outside. In the heat exchange room R1, heat exchange between the outdoor heat exchanger 11 and air received from the outside may occur. In the heat exchange room R1, components, such as the outdoor heat exchanger 11, the outdoor fan 13, etc., may be positioned.

The outdoor unit 10 may include a machine room R2 formed inside the housing 100. In the machine room R2, components, such as the compressor 12, the control boxes 800 and 900 which will be described below, etc., may be positioned.

Inside the housing 100, the heat exchange room R1 may be partitioned from the machine room R2. The outdoor unit 10 may include a partition 16 that partitions the heat exchange room R1 from the machine room R2. The partition 16 may be positioned between the heat exchange room R1 and the machine room R2. For example, the heat exchange room R1 and the machine room R2 may be arranged in a left-right direction (Y direction) in the drawings, and the partition 16 may extend in a front-rear direction (X direction) and an upper-lower direction (Z direction) in the drawings to partition the heat exchange room R1 from the machine room R2.

The partition 16 may be coupled to the housing 100. For example, the partition 16 may be coupled to a base 172 which will be described below. For example, the partition 16 may be coupled to front frames 110 and 120 which will be described below. However, the partition 16 may be integrated into a certain component of the housing 100.

A structure of the partition 16 will be described in greater detail below.

For example, the housing 100 may have a box shape.

Hereinafter, an example of a structure of the housing 100 will be described.

The housing 100 may include a first front frame 110. The first front frame 110 may cover the heat exchange room R1 in a front direction (+X direction) of the heat exchanger room R1. The outlet 111 may be formed in the first front frame 110.

The housing 100 may include a second front frame 120. The second front frame 120 may cover the machine room R2 in a front direction (+X direction) of the machine room R2. For example, the second front frame 120 may be formed in a shape of a substantially flat plate.

For example, the first front frame 110 and the second front frame 120 may be aligned side by side in the left-right direction (Y direction). The first front frame 110 may be coupled to the second front frame 120.

For example, in the second front frame 120, a plurality of heat dissipation holes may be formed such that the machine room R1 communicates with the outside of the outdoor unit 10 to discharge internal heat of the machine room R2.

The housing 100 may include a first rear frame 130. The first rear frame 130 may form a part of a rear appearance of the outdoor unit 10. The first rear frame 130 may be positioned in a rear direction (−X direction) of the heat exchange room R1. The inlet 131 may be formed in the first rear frame 130.

The first rear frame 130 may be opposite to the first front frame 110.

The housing 100 may include a second rear frame 140. The second rear frame 140 may form another part of the rear appearance of the outdoor unit 10. The second rear frame 140 may cover the machine room R2 in a rear direction (−X direction) of the machine room R1.

For example, in the second rear frame 140, a plurality of heat dissipation holes may be formed such that the machine room R2 communicates with the outside of the outdoor unit 11 to discharge internal heat of the machine room R2.

The second rear frame 140 may be opposite to the second front frame 120.

The housing 100 may include a first side frame 150. The first side frame 150 may form a surface of the outdoor unit 10 in a left direction (−Y direction) of the outdoor unit 10.

The first side frame 150 may cover the heat exchange room R1. The first side frame 150 may cover the heat exchange room R1 in a left direction (−Y direction) of the heat exchange room R1. An inlet 151 may be formed in the first side frame 150.

The first side frame 150 may be coupled to the first front frame 110. The first side frame 150 may be connected to the first rear frame 130.

For example, the first side frame 150 may extend in the front-rear direction (X direction).

The housing 100 may include a second side frame 160. The second side frame 160 may form a surface of the outdoor unit 10 in a right direction (+Y direction).

The second side frame 160 may cover the machine room R2. The second side frame 160 may cover the machine room R2 in the right direction (+Y direction).

For example, in the second side frame 160, a plurality of heat dissipation holes may be formed such that the machine room R2 communicates with the outside of the outdoor unit 10 to discharge internal heat of the machine room R2.

The second side frame 160 may be coupled to the second front frame 120. The second side frame 160 may be coupled to the second rear frame 140.

For example, the second side frame 160 may extend in the front-rear direction (X direction).

The second side frame 160 may be opposite to the first side frame 150.

The housing 100 may include the base 172. The base 172 may form a lower surface of the outdoor unit 10. The base 172 may be positioned in one sides of the heat exchange room R1 and the machine room R2 in the lower direction (−Z direction). The base 172 may support various components of the outdoor unit 10 accommodated inside the housing 100 from below. For example, the base 172 may support components, such as the outdoor heat exchanger 11, the compressor 12, a motor bracket 15, and the partition 16, from below.

The base 172 may be coupled to a lower portion of each of the first front frame 110, the second front frame 120, the second rear frame 140, the first side frame 150, and the second side frame 160.

The base 172 may be formed in a shape of a substantially flat plate.

The housing 100 may include a top cover 171. The top cover 171 may form an upper surface of the outdoor unit 10.

The top cover 171 may cover the heat exchange room R1 and the machine room R2 in the upper direction (+Z direction). The top cover 171 may cover various components of the outdoor unit 10 accommodated inside the housing 100 from above.

The top cover 171 may be coupled to an upper portion of each of the first front frame 110, the second front frame 120, the second rear frame 140, the first side frame 150, and the second side frame 160.

The top cover 171 may be formed in a shape of a substantially flat plate.

The top cover 171 may be opposite to the base 172.

The housing 100 may include the outlet grille 180. The outlet grille 180 may cover the first front frame 110 in the front direction (+X direction). The outlet grille 180 may cover the outlet 111 in the front direction (+X direction). The outlet grille 180 may be coupled to the first front frame 110. The outlet grille 180 may form a part of a front appearance of the outdoor unit 10.

The outlet grille 180 may cover the outlet 111 and have substantially a grille shape through which air is discharged from the outlet 11.

The housing 100 may include the front cover 190. The front cover 190 may cover the second front frame 120 in the front direction (+X direction). The front cover 190 may be coupled to the second front frame 120. The front cover 190 may form another part of the front appearance of the outdoor unit 10.

For example, the outlet grille 180 and the front cover 190 may be aligned side by side in the left-right direction (Y-direction). The outlet grille 180 may be coupled to the front cover 190.

Components included in the housing 100 may be detachable from each other. For example, the second front frame 120 may be detachable from the first front frame 110, the second side frame 160, the top cover 171, the base 172, etc. For example, the second side frame 160 may be detachable from the second front frame 120, the second rear frame 140, the top cover 171, the base 172, etc. For example, the top cover 171 may be detachable from the first front frame 110, the second front frame 120, the second rear frame 140, the first side frame 150, and the second side frame 160, etc.

Accordingly, in the case in which a task of inspecting, replacing or repairing a component(s) inside the outdoor unit 10 needs to be performed, a worker may perform the task by detaching at least one component of the housing 100.

A configuration of a housing that may be included in an air conditioner according to the disclosure is not limited to that described above.

The outdoor heat exchanger 11 may exchange heat with outside air. A refrigerant may flow through the outdoor heat exchanger 11. In the outdoor heat exchanger 11, heat exchange between a refrigerant and outside air may occur.

For example, during a cooling operation of the air conditioner 1, a high-pressure and high-temperature refrigerant gas may be condensed in the outdoor heat exchanger 11, and while the refrigerant is condensed, the refrigerant may emit heat to indoor air. During the cooling operation of the air conditioner 1, the outdoor heat exchanger 11 may discharge a refrigerant liquid.

During a heating operation of the air conditioner 1, a low-temperature and low-pressure refrigerant liquid may be evaporated in the outdoor heat exchanger 11, and while the refrigerant is evaporated, the refrigerant may absorb heat from outside air. During the heating operation of the air conditioner 1, the outdoor heat exchanger 11 may discharge a refrigerant gas.

The outdoor heat exchanger 11 may face the inlets 131 and 151 in the heat exchange room R1.

The compressor 12 may compress a refrigerant gas and discharge a high-temperature and high-pressure refrigerant gas. For example, the compressor 12 may include a motor and a compression mechanism, and the compression mechanism may compress the refrigerant gas by a torque of the motor.

The outdoor unit 10 may include the outdoor fan 13 for causing air to flow, and a fan motor 14 for generating a rotational force for the outdoor fan 13 to rotate.

For example, the outdoor unit 10 may include the motor bracket 15 that supports the outdoor fan 13 and the fan motor 14. The motor bracket 15 may be positioned in the heat exchange room R1.

For example, the outdoor unit 10 may include a plate heat exchanger 21. The plate heat exchanger 21 may perform heat exchange between a refrigerant and water. The plate heat exchanger 21 may be positioned inside the housing 100. For example, the plate heat exchanger 21 may be positioned inside the machine room R2.

For example, the outdoor unit 10 may include a water pipe 23 through which water flows into the outdoor unit 10 from the outside or water is discharged from the outdoor unit 10. The water pipe 23 may be connected to the plate heat exchanger 21. At least one part of the water pipe 23 may be positioned inside the housing 100. For example, at least one part of the water pipe 23 may be positioned in the machine room R2.

Water flowing into the outdoor unit 10 through the water pipe 23 from the outside may be heat-exchanged with a high-temperature refrigerant within the plate heat exchanger 21. The water may absorb heat from the high-temperature refrigerant within the plate heat exchanger 21 and then be transferred to the outside of the outdoor unit 10 through the water pipe 23.

For example, the outdoor unit 10 may include an expansion tank 22. According to a rise in temperature of water by the plate heat exchanger 21, a volume of water in the water pipe 23 may increase, and in this case, the expansion tank 22 may prevent and/or reduce pressure of the water from rising suddenly. The expansion tank 22 may be positioned inside the housing 100. For example, the expansion tank 22 may be positioned in the machine room R2.

As such, the outdoor unit 10 according to an embodiment may include a part of a heating system that supplies hot water by including the plate heat exchanger 21, the water pipe 23, and the expansion tank 22.

However, the disclosure is not limited thereto, and in the air conditioner according to an embodiment, the plate heat exchanger, the water pipe, and the expansion tank may be provided outside the outdoor unit. The air conditioner according to an embodiment may not be equipped with a heating system.

The outdoor unit 10 may include a plurality of Printed Circuit Boards (PCBs) 81, 82, and 83 (see, e.g., FIGS. 4 and 14) for controlling driving of various components of the outdoor unit 10. Various electronic components may be mounted on the plurality of PCBs 81, 82, and 83. The outdoor unit 10 may include the control boxes 800 and 900 that accommodate the plurality of PCBs 81, 82, and 83.

For example, the outdoor unit 10 may include a first control box 800. The first control box 800 may be accommodated inside the housing 100. The first control box 800 may be positioned in the machine room R2.

As shown in FIG. 3, for example, the first control box 800 may be positioned at a front area of the machine room R2, and covered by the second front frame 120.

For example, the outdoor unit 10 may include a second control box 900. The second control box 900 may be accommodated inside the housing 100. The second control box 900 may be positioned in the machine room R2.

As shown in FIG. 3, for example, the second control box 900 may be positioned at a right area of the machine room R2, and covered by the second side frame 160.

The outdoor unit 10 may include a duct 400. The duct 400 may be connected to the control boxes 800 and 900.

The duct 400 may be positioned in the machine room R2. The duct 400 may connect an inside space of the machine room R2 to the heat exchange room R1. The duct 400 may discharge heat generated inside the control boxes 800 and 900 to the heat exchange room R1.

For example, the duct 400 may allow an inside of the first control box 800 to communicate with the heat exchange room R1. For example, the duct 400 may allow an inside of the second control box 900 to communicate with the heat exchange room R1.

According to driving of the outdoor fan 13, inside air of the machine room R2 may flow into the heat exchange room R1 via the duct 400 by a suction force of the outdoor fan 13. Therefore, a refrigerant gas leaked, for example, from an internal component of the outdoor unit 10 and then flowed into the control boxes 800 and 900 may flow into the heat exchange room R1 via the duct 400. Heat generated inside the control boxes 800 and 900 may be discharged to the heat exchange room R1 via the duct 400.

The outdoor unit 10 may include a coupling duct 500. The coupling duct 500 may connect the partition 16 to the duct 400. The coupling duct 500 may be coupled to the partition 16 and the duct 400. Therefore, according to driving of the outdoor fan 13, inside air of the machine room R2 may flow into the heat exchange room R1 by sequentially passing through the duct 400 and the coupling duct 500 by a suction force of the outdoor fan 13.

However, the disclosure is not limited thereto, and the coupling duct 500 may be integrated into the duct 400. Alternatively, the duct 400 may be connected to the partition 16 without the coupling duct 500.

Structures of the duct 400 and the coupling duct 500 will be described in greater detail below.

The above-described configuration of the outdoor unit 10 may be only an example of the outdoor unit of the air conditioner according to the disclosure, and the disclosure is not limited thereto. The outdoor unit of the air conditioner according to the disclosure may have various structures so long as outside air flows into the outdoor unit through an inlet and the air is heat-exchanged and then discharged to the outside.

Figure 4:
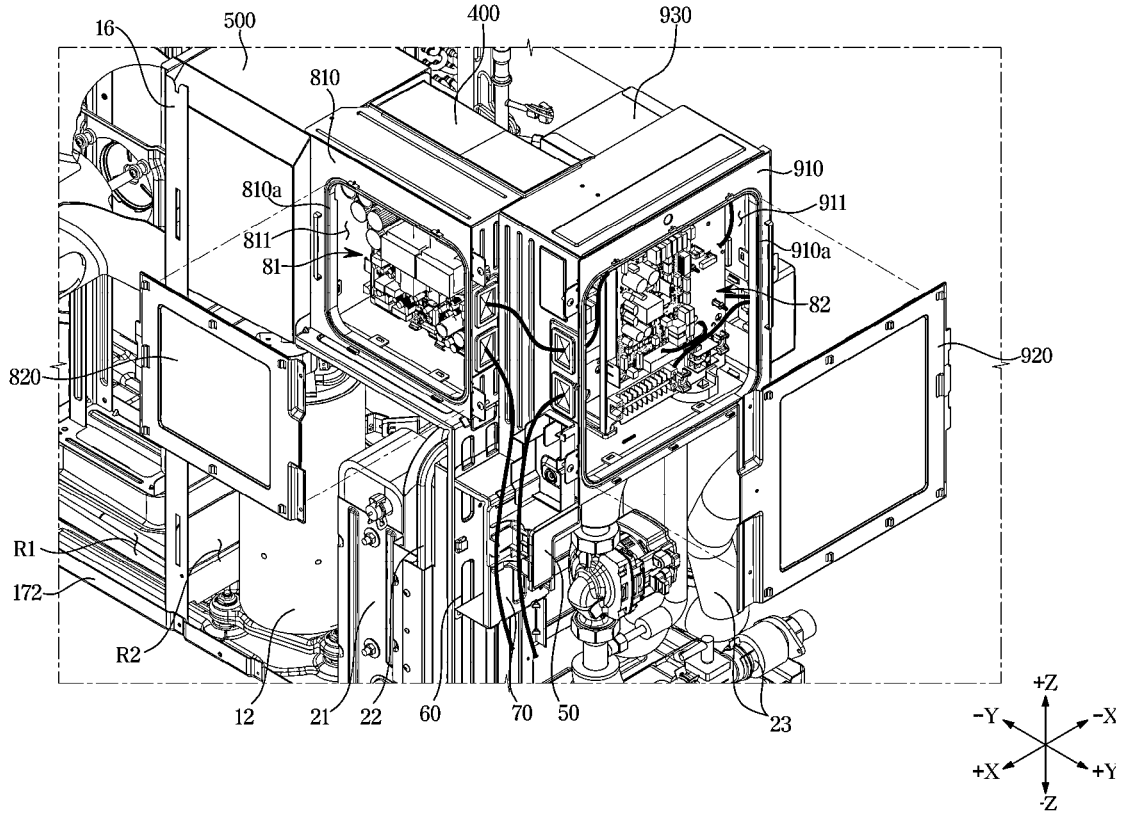
FIG. 4 is an enlarged perspective view illustrating various components of an outdoor unit of an air conditioner according to various embodiments.

FIG. 4 is an enlarged perspective view illustrating various components of an outdoor unit of an air conditioner according to various embodiments.

Referring to FIG. 4, the outdoor unit 10 of the air conditioner 1 according to an embodiment of the disclosure may include the first control box 800 and the second control box 900.

Each of the first control box 800 and the second control box 900 may accommodate a PCB (or some PCBs) among the plurality of PCBs provided in the outdoor unit 10.

For example, the outdoor unit 10 may include a first PCB 81, a second PCB 82, and a third PCB 83. Each of the first control box 800 and the second control box 900 may accommodate a PCB (or some PCBs) among the first PCB 81, the second PCB 82, and the third PCB 83 (see FIG. 14).

For example, the first PCB 81 may be accommodated in the first control box 800. For example, the second PCB 82 may be accommodated in the second control box 900. For example, the third PCB 83 may be accommodated in the second control box 900.

The first control box 800 may include a first case 810. For example, the first case 810 may accommodate the first PCB 81. The first case 810 may include a first accommodating space 811 to accommodate the first PCB 81.

One side of the first case 810 may open. That is, the first case 810 may include a first case opening 810*a* formed at one side. For example, the first PCB 81 may be inserted into or taken out of the first case 810 through the first case opening 810*a*. A worker may access the first PCB 81 accommodated inside the first case 810 through the first case opening 810*a* and perform a task.

For example, the first case opening 810*a* may be formed at one side of the first case 810 in the front direction (+X direction). That is, the first case 810 may open in the front direction (+X direction).

For example, the first case 810 may be substantially in a shape of a box.

The first control box 800 may include a first case cover 820 detachably coupled to the first case 810. The first case cover 820 may be coupled to the first case 810 to close the first case opening 810*a*. The first case cover 820 may be detached from the first case 810 to open the first case opening 810*a*. For example, a manufacturer of the first control box 800 may insert the first PCB 81 into the first case 810 and then couple the first case cover 820 to the first case 810, thereby covering an inside space of the first case 810. A worker who intends to inspect the first PCB 81 or replace/repair a component inside the first control box 800 may access the first PCB 81 by detaching the first case cover 820 from the first case 810.

For example, the first case cover 820 may be coupled to the first case 810 in the front direction (+X direction). That is, the first case cover 820 may cover the first PCB 81 in the front direction (+X direction).

For example, the first case cover 820 may be formed in a shape of a substantially flat plate.

As such, the first PCB 81 inside the first case 810 may be protected from an external impact, external foreign materials, a leaking refrigerant gas, etc., by the first case cover 820. In addition, because the first case cover 820 is detachable from the first case 810, a worker may access the first PCB 81 as necessary.

The second control box 900 may include a second case 910. For example, the second case 910 may accommodate the second PCB 82 and the third PCB 83 (see FIG. 14). The second case 910 may include a second accommodating space 911 in which the second PCB 82 and the third PCB 83 are accommodated.

One side of the second case 910 may open. That is, the second case 910 may include a second case opening 910*a* formed at one side. For example, the second PCB 82 and the third PCB 83 (see FIG. 14) may be inserted into or taken out of the second case 910 through the second case opening 910*a*. The worker may access the second PCB 82 and the third PCB 83 accommodated inside the second case 910 through the second case opening 910*a* and perform a task.

For example, the second case opening 910*a* may be formed in one side of the second case 910 in the right direction (+Y direction). For example, the second case 910 may open in the right direction (+Y direction), although not limited thereto. However, an open side of the second case 910 may depend on a factor such as a position of the second case 910 inside the housing 100.

For example, the second case 910 may be formed substantially in a shape of a box.

The second control box 900 may include a second case cover 920 detachably coupled to the second case 910. The second case cover 920 may be coupled to the second case 910 to close the second case opening 910*a*. The second case cover 920 may be detached from the second case 910 to open the second case opening 910*a*. For example, a manufacturer of the second control box 900 may insert the second PCB 82 and the third PCB 83 (see FIG. 14) into the second case 910 and then couple the second case cover 920 to the second case 910 to cover an inside space of the second case 910. A worker who intends to inspect the second PCB 82 and the third PCB 83 or replace/repair a component inside the second control box 900 may access the second PCB 82 and the third PCB 83 by detaching the second case cover 920 from the second case 910.

For example, the second case cover 920 may be coupled to one side of the second case 910 in the right direction (+Y direction). That is, the second case cover 920 may cover the second PCB 82 and the third PCB 83 in the right direction (+Y direction).

For example, the second case cover 920 may be formed in a shape of a substantially flat plate.

As such, the second PCB 82 and the third PCB 83 (see FIG. 14) inside the second case 910 may be protected from an external impact, external foreign materials, a leaking refrigerant gas, etc., by the second case cover 920. In addition, because the second case cover 920 is detachable from the second case 610, a worker may access the second PCB 82 and the third PCB 83 as necessary.

A structure of the second control box 900 will be described in greater detail, below.

The plurality of PCBs 81, 82, and 83 provided in the outdoor unit 10 may supply power to various components of the outdoor unit 10, such as the compressor 12, the fan motor 14, the plate heat exchanger 21, and the expansion tank 22. The plurality of PCBs 81, 82, and 83 may control operations of various components of the outdoor unit 10, such as the compressor 12, the fan motor 14, the plate heat exchanger 21, and the expansion tank 22. Alternatively, the plurality of PCBs 81, 82, and 83 may receive sensing signals from various sensors (not shown) provided in the compressor 12, the outdoor heat exchanger 11, etc. The plurality of PCBs 81, 82, and 83 may be electrically connected to various components of the outdoor unit 10 by wires.

For example, the first PCB 81, the second PCB 82, and the third PCB 83 (see FIG. 14) may be electrically connected to various components of the outdoor unit 10 by wires. Alternatively, the first PCB 81, the second PCB 82, and the third PCB 83 (see FIG. 14) may be electrically connected to each other by wires. Alternatively, the first PCB 81, the second PCB 82, and the third PCB 83 (see FIG. 14) may be electrically connected to devices (not shown) positioned outside the outdoor unit 10 by wires.

For example, the first PCB 81 may be connected to the second PCB 82 or the third PCB 83 by a wire penetrating the first case 810 and the second case 910. For example, the first PCB 81 may be connected to various components of the outdoor unit 10 by a wire penetrating the second case 910.

For example, the second PCB 82 may be connected to the first PCB 81 by a wire penetrating the first case 810 and the second case 910. For example, the second PCB 82 may be connected to various components of the outdoor unit 10 by a wire penetrating the second case 910. For example, the second PCB 82 may be connected to the third PCB 83 by a wire positioned inside the second case 910.

For example, the second PCB 83 may be connected to the first PCB 81 by a wire penetrating the first case 810 and the second case 910. For example, the third PCB 83 may be connected to various components of the outdoor unit 10 by a wire penetrating the second case 910. For example, the third PCB 83 may be connected to the third PCB 83 by a wire positioned inside the second case 910.

For example, the second control box 900 may include a noise filter 930 for reducing noise of current. For example, the noise filter 930 may be coupled to the second case 910 in the left direction (−Y direction).

The outdoor unit 10 may include a wire guide 50. The wire guide 50 may fix/support a part of the wires connected to the first PCB 81, the second PCB 82, and the third PCB 83. For example, the wire guide 50 may be coupled to and supported by the second control box 900.

The first control box 800 and the second control box 900 may be supported inside the housing 100.

For example, the outdoor unit 10 may include a first support frame 60 provided inside the housing 100. For example, the first support frame 60 may support lower portions of the first control box 800 and the second control box 900. For example, the first support frame 60 may be supported by the base 172.

For example, the outdoor unit 10 may include a second support frame 70 provided inside the housing 100. For example, the second support frame 70 may support a lower portion of the second control box 900. For example, the second support frame 70 may be supported by the first support frame 60.

The above-described components of the first control box 800 and the second control box 900 may be an example of control boxes that are included in the outdoor unit of the air conditioner according to the disclosure and accommodate PCBs. However, the disclosure is not limited thereto.

As shown in FIGS. 2, 3 and 4 (which may be referred to as FIGS. 2 to 4), the control boxes 800 and 900 may be installed such that the case covers 820 and 920 face the outside of the housing 100. In other words, the control boxes 800 and 900 may be installed such that the case openings 810*a* and 910*a* of the cases 810 and 910 face the outside of the housing 100.

For example, the first control box 800 may be installed such that the first case cover 820 and the first case opening 810*a* are toward the front direction (+X direction) of the outdoor unit 10. The first control box 800 may be installed such that the first case cover 820 and the first case opening 810*a* are toward the front direction (+X direction) of the housing 100. The first control box 800 may be installed such that the first case cover 820 and the first case opening 810*a* are toward the second front frame 120. The first control box 800 may be installed such that the first case cover 820 and the first case opening 810*a* are located adjacent to the second front frame 120. By this structure, a worker who intends to access the first PCB 81 may easily access the first PCB 81 inside the first case 810 by separating the second front frame 120 in the front direction of the outdoor unit 10 and separating the first case cover 820 from the first case 810.

For example, the second control box 900 may be installed such that the second case cover 910 and the second case opening 910*a* are toward the right direction (Y+ direction) of the outdoor unit 10. The second control box 900 may be installed such that the second case cover 920 and the second case opening 10*a* are toward the right direction (+Y direction) of the housing 100. The second control box 900 may be installed such that the second case cover 920 and the second case opening 10*a* are toward the second side frame 160. The second control box 900 may be installed such that the second case cover 920 and the second case opening 910*a* are located adjacent to the second side frame 160. By this structure, a worker who intends to access the second PCB 82 or the third PCB 83 may easily access the second PCB 82 or the third PCB 83 inside the second case 910 by separating the second side frame 160 in the left direction of the outdoor unit 10 and separating the second case cover 920 from the second case 910.

The air conditioner 1 according to an embodiment of the disclosure may operate using heat exchange that occurs while a refrigerant is evaporated/condensed, as described above. As such, kinds of refrigerants capable of being used for an operation of the air conditioner 1 may be numerous.

However, some kinds of refrigerants among refrigerants capable of being used for the air conditioner 1 may contain highly flammable substances. For example, a R290 refrigerant that is a kind of refrigerants capable of being used in a cooling cycle of various types of air conditioners including the air conditioner 1 according to an embodiment is a natural hydrocarbon refrigerant containing propane, and the R290 refrigerant has an advantage of being an eco-friendly refrigerant with very low ozone depletion potential (ODP) and global warming potential (GWP), but has a disadvantage of being relatively highly flammable compared to other kinds of refrigerants.

Therefore, in the case in which a highly flammable type of refrigerant such as R290 refrigerant is used in the air conditioner 1 according to an embodiment, leakage of the refrigerant from various components in the outdoor unit 10, such as the compressor 12, the outdoor heat exchanger 11, or refrigerant pipes connecting the compressor 12 and the outdoor heat exchanger 11 to each other, may increase a risk of fire. Particularly, in the case in which a leaking refrigerant enters the control boxes 800 and 900 and various electronic components or wires in the control boxes 800 and 900 are exposed to the refrigerant, a possibility of fire occurrence may further increase.

As shown in FIGS. 2 to 4, the control boxes 800 and 900 may be installed such that the case openings 810*a* and 910*a* of the cases 810 and 910 are toward the outside of the housing 100 and the case openings 810*a* and 910*a* are adjacent to an inner surface of the housing 100. By this structure, a refrigerant leaked from various components in the outdoor unit 10 may be prevented or reduced from flowing into the insides of the cases 810 and 910 through the case openings 810*a* and 910*a*.

Figure 5:
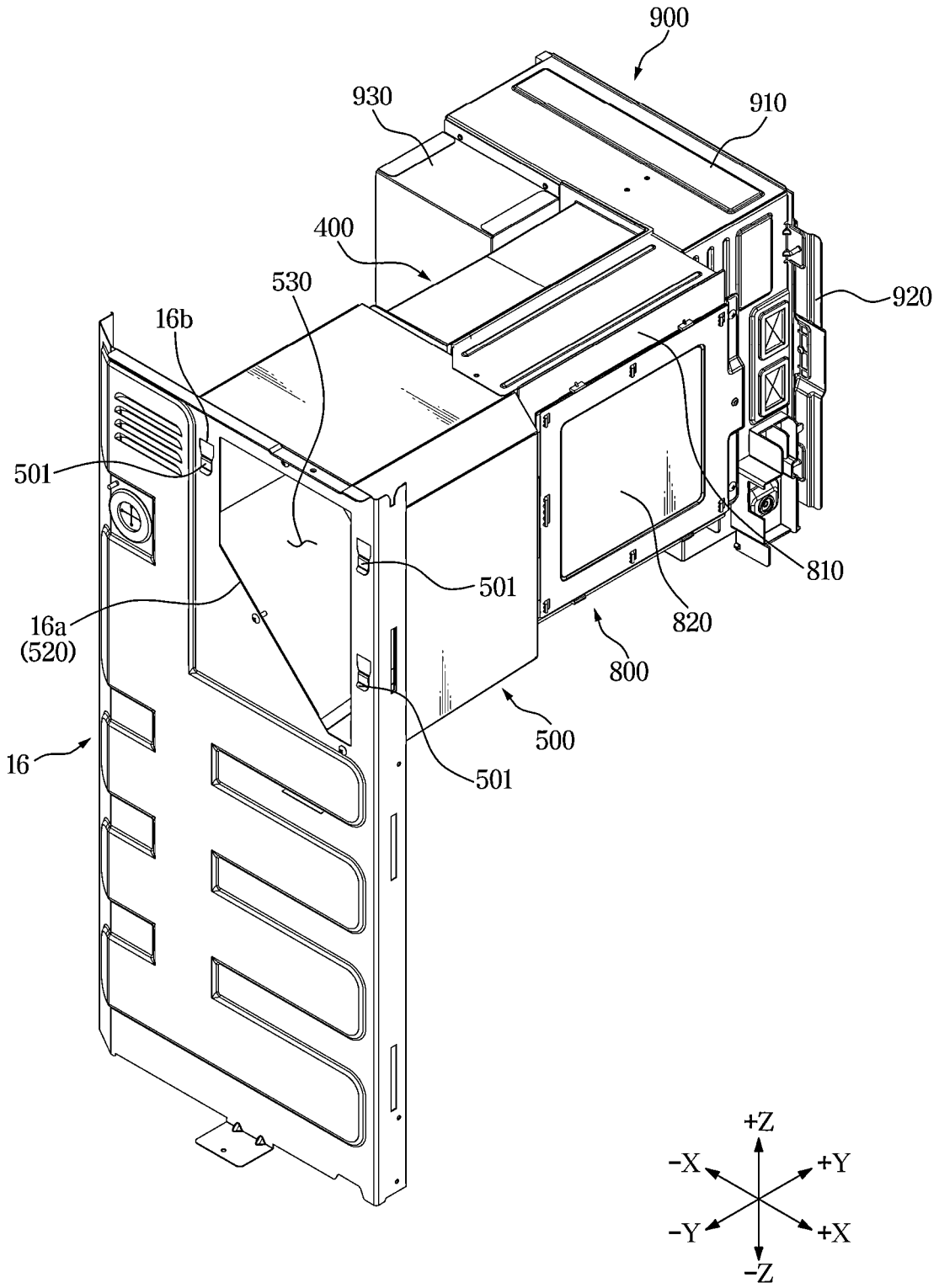
FIG. 5 is a perspective view illustrating various components of an outdoor unit of an air conditioner according to various embodiments.
Figure 6:
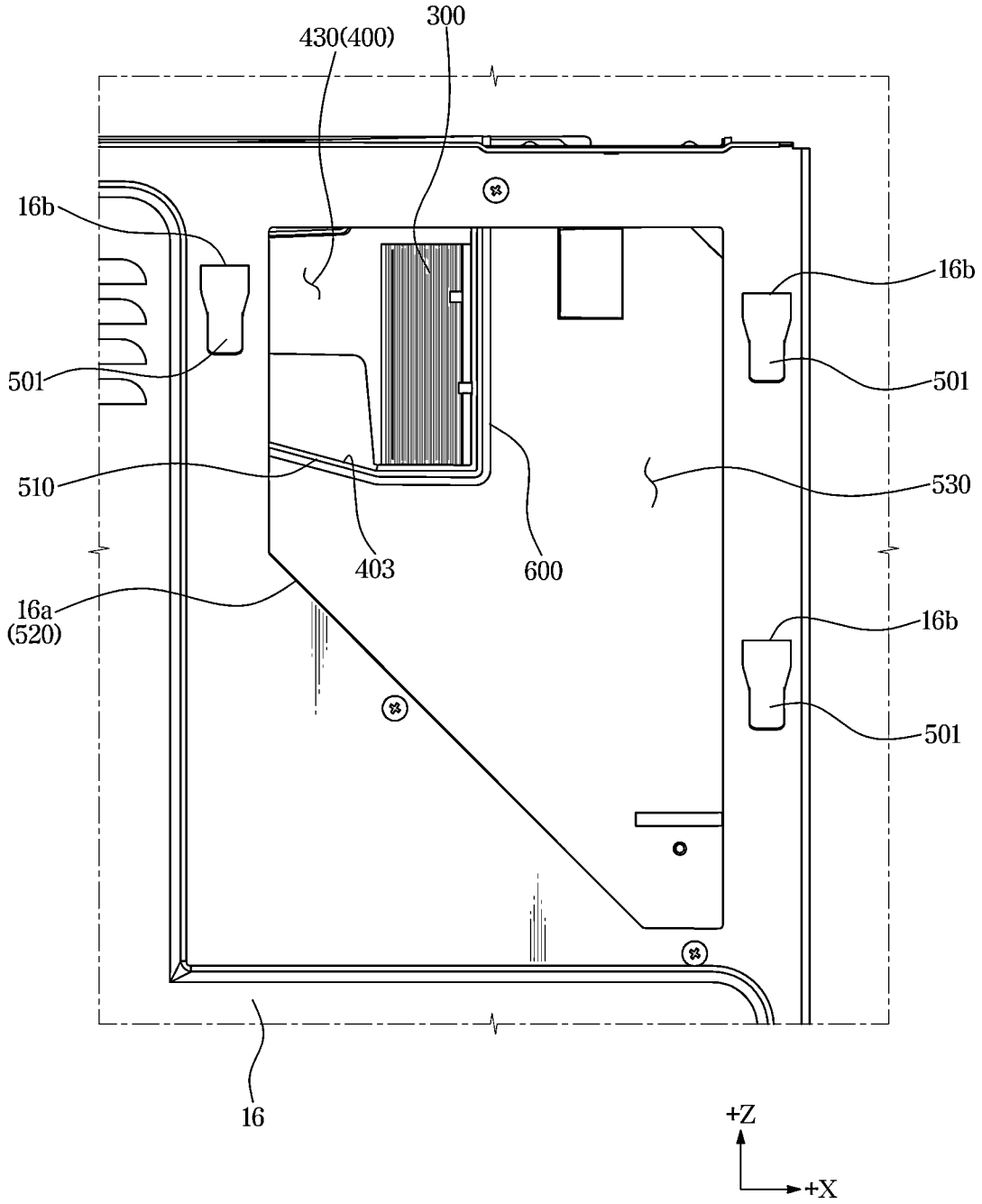
FIG. 6 is a diagram illustrating an example partition of an outdoor unit of an air conditioner viewed in one direction according to various embodiments.
Figure 7:
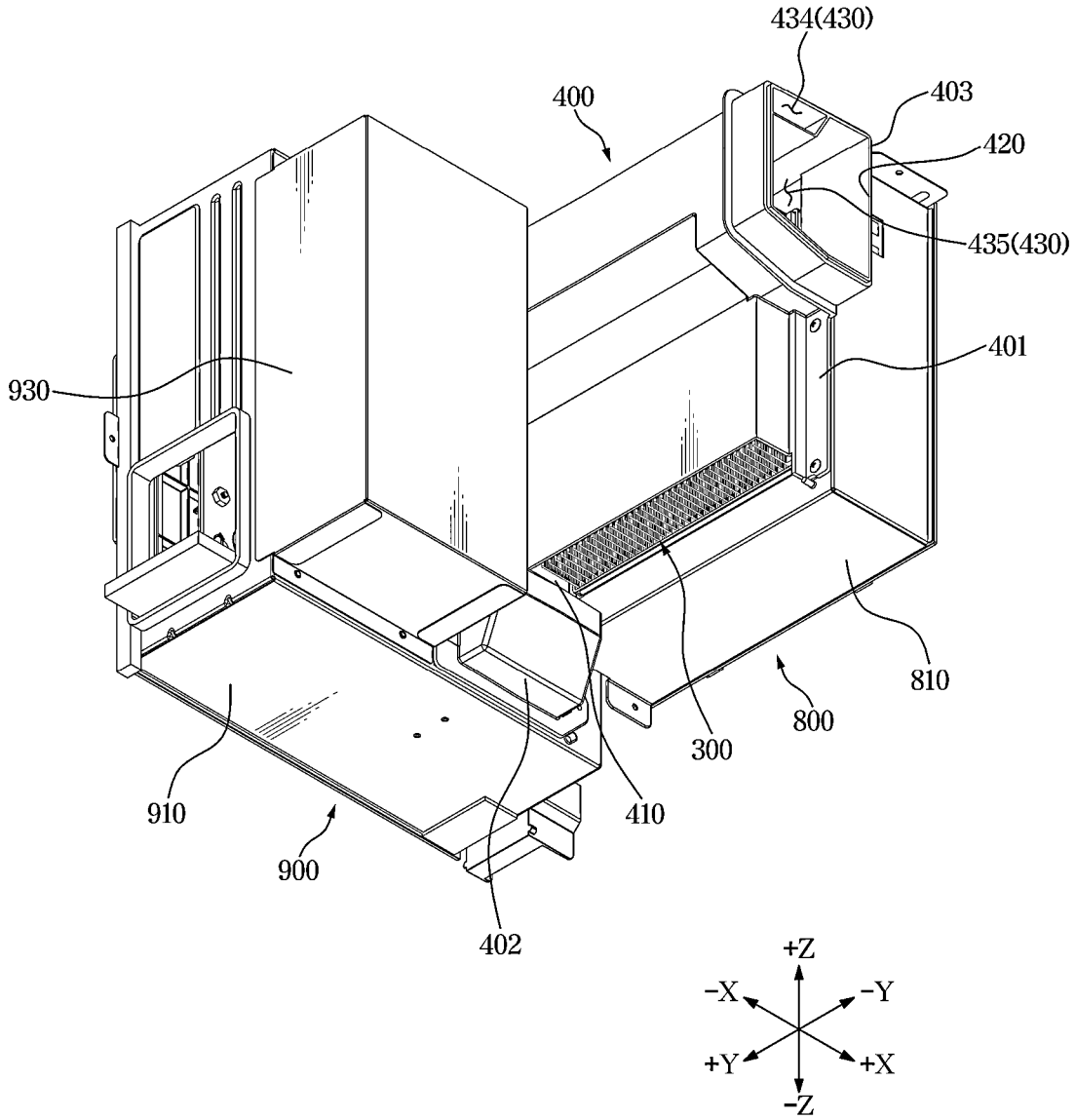
FIG. 7 is a perspective view illustrating an example control box and duct of an outdoor unit of an air conditioner according to various embodiments.
Figure 8:
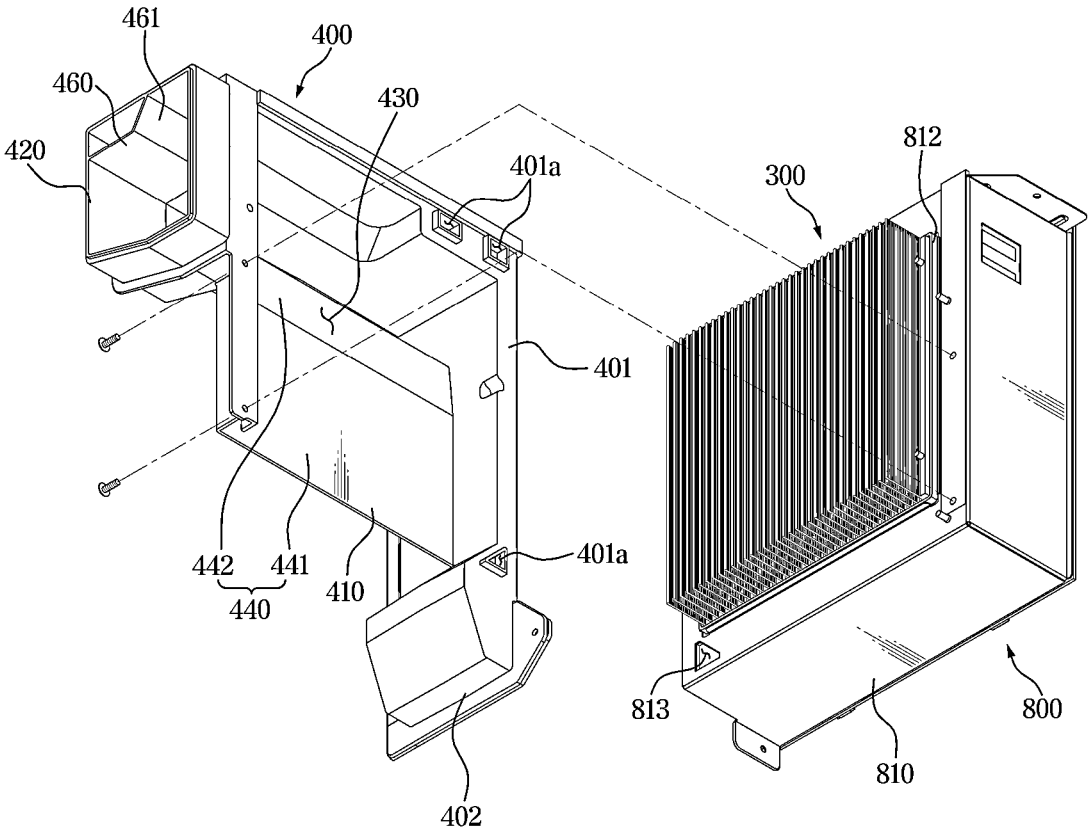
FIG. 8 is an exploded perspective view illustrating a first control box and a duct of an outdoor unit of an air conditioner according to various embodiments.

FIG. 5 is a perspective view illustrating various components of an outdoor unit of an air conditioner according to various embodiments. FIG. 6 is a diagram illustrating a partition of an outdoor unit of an air conditioner viewed in one direction according to various embodiments. FIG. 7 is a perspective view illustrating an example control box and duct of an outdoor unit of an air conditioner according to various embodiments FIG. 8 is an exploded perspective view illustrating a first control box and a duct of an outdoor unit of an air conditioner according to various embodiments.

Referring to FIGS. 5, 6, 7 and 8 (which may be referred to as FIGS. 5 to 8), the outdoor unit 10 of the air conditioner 1 according to an embodiment of the disclosure may include a heat sink 300.

The heat sink 300 may discharge heat generated inside the first control box 800 to the outside of the first control box 800. For example, the heat sink 300 may discharge heat generated in the first PCB 81 to the outside of the first control box 800. In other words, the heat sink 300 may discharge heat generated in the first PCB 81 to the outside of the first case 810.

The heat sink 300 may be connected to the first PCB 81. Heat generated in the first PCB 81 may be conducted to the heat sink 300. The heat sink 300 may transfer the heat to surrounding air by convection of the surrounding air.

At least one portion of the heat sink 300 may be positioned outside the first control box 800. For example, at least a major part of the heat sink 300 may be positioned outside the first control box 800. By this arrangement, the heat sink 300 may efficiently transfer heat to outside air of the first control box 800.

The heat sink 300 may be installed in the first control box 800. For example, the first case 810 may include a heat sink installing portion 812 in which the heat sink 300 is installed. The heat sink installing portion 812 may be formed in one side of the first case 810.

For example, the heat sink 300 may be connected to the first PCB 81 by penetrating one side of the first case 810. For example, the heat sink 300 may be connected to the first PCB 81 by penetrating the heat sink installing portion 812. The heat sink 300 may penetrate the heat sink installing portion 812. For example, the heat sink installing portion 812 may include an opening through which the heat sink 300 passes.

The heat sink 300 may be installed in a side of the first control box 800, which is opposite to the first case opening 810*a* of the first control box 800. The heat sink installing portion 812 may be opposite to the first case opening 810*a*.

As described above, the first control box 800 may be installed inside the machine room R2 such that the first case opening 810*a* and the first case cover 820 are toward the front direction (+X direction) of the housing 100. Accordingly, the heat sink 300 may be installed behind the first control box 800 in the −X direction. In other words, the heat sink 300 may be installed behind the first case 810 in the −X direction. The heat sink installing portion 812 may be formed on a rear surface of the first case 810.

By this structure, the heat sink 300 may discharge heat in the rear direction (−X direction) of the first case 810.

A structure of the heat sink 300 will be described in greater detail, below.

The outdoor unit 10 of the air conditioner 1 according to an embodiment of the disclosure may include the duct 400.

The duct 400 may be positioned inside the housing 100. For example, the duct 400 may be positioned in the machine room R2. The duct 400 may be connected to the inside space of the machine room R2. For example, an entire of the duct 400 may be positioned in the machine room R2. For example, a major part of the duct 400 may be positioned in the machine room R2, and another part of the duct 400 may be positioned in the heat exchange room R1 by penetrating the partition 16.

The duct 400 may connect the inside space of the machine room R2 to the heat exchange room R1. For example, the duct 400 may be positioned such that the inside space of the machine room R2 outside the duct 400 is connected to the heat exchange room R1. While the outdoor fan 13 of the heat exchange room R1 is driven, inside air of the machine room R2 may flow into the heat exchange room R1 through the duct 400.

The duct 400 may accommodate the heat sink 300. At least one part of the heat sink 300 may be positioned inside the duct 400. The duct 400 may cover the heat sink 300.

The duct 400 may be positioned to one side of the first control box 800. More specifically, the duct 400 may be positioned in a direction in which the heat sink 300 is installed with respect to the first control box 800. For example, the duct 400 may be positioned behind the first control box 800 in the −X direction to accommodate the heat sink 300.

For example, the duct 400 may be positioned to one side of the second control box 900. As shown in FIG. 5, the duct 400 may be positioned in the left direction (−Y direction) of the second control box 900.

Air flowing from the inside of the machine room R2 to the heat exchange room R1 according to driving of the outdoor fan 13 of the heat exchange room R1 may pass through the heat sink 300 and exchange heat with the heat sink 300. That is, the heat sink 300 may exchange heat with air flowing inside the duct 400. The heat sink 300 may receive heat generated inside the first control box 800 and transfer the received heat to air flowing inside the duct 400.

Accordingly, the duct 400 may discharge the heat transferred from the heat sink 300 to the heat exchange room R1. The duct 400 may discharge a refrigerant gas leaked into the machine room R2 to the heat exchange room R1.

For example, the duct 400 may be connected to the heat exchange room R1 through the partition 16. The duct 400 may be connected to the partition 16, and connected to the heat exchange room R1 through a part connected to the partition 16.

For example, the partition 16 may include a partition opening 16*a*. The partition opening 16*a* may be formed by opening a part of the partition 16. The partition opening 16*a* may connect the heat exchange room R1 to the machine room R2.

For example, the partition opening 16*a* may have a shape of penetrating the partition 16 in a horizontal direction (Y direction). According to driving of the outdoor fan 13 of the heat exchange room R1, air of the machine room R2 may pass through the partition opening 16*a* in the horizontal direction and flow into the heat exchange room R1.

The duct 400 may be connected to the partition opening 16*a*. The duct 400 may be connected to the heat exchange room R1 through the partition opening 16*a*. An inside space of the duct 400 may be connected to the heat exchange room R1 through the partition opening 16*a*. That is, according to driving of the outdoor fan 13 of the heat exchange room R1, inside air of the machine room R2 may pass through the duct 400 and the partition opening 16*a* and flow into the heat exchange room R1. Inside air of the duct 400 may be discharged to the heat exchange room R1 through the partition opening 16*a*.

A distance between the first control box 800 and the partition 16 may depend on a length of the machine room R2 in the horizontal direction (Y direction). For example, as a length of the machine room R2 in the horizontal direction (Y direction) increases, a distance between the first control box 800 and the partition 16 may increase. In this case, the duct 400 positioned to one side of the first control box 800 may be spaced a preset distance from the partition 16.

Referring to FIGS. 5 and 6, the outdoor unit 10 may include the coupling duct 500 provided between the duct 400 and the partition 16. The coupling duct 500 may connect the duct 400 to the partition 16. The coupling duct 500 may extend from the duct 400 to the partition 16.

The coupling duct 500 may be positioned inside the housing 100. For example, the coupling duct 500 may be positioned in the machine room R2. The coupling duct 500 may be connected to the inside space of the machine room R2. For example, an entire of the coupling duct 500 may be positioned in the machine room R2. Alternatively, a major part of the coupling duct 500 may be positioned in the machine room R2, and another part of the coupling duct 500 may be positioned in the heat exchange room R1 by penetrating the partition 16.

The coupling duct 500 may connect an inside (for example, a duct flow path 430 which will be described in greater detail below) of the duct 400 to the heat exchange room R1. The coupling duct 500 may discharge inside air of the duct 400 to the heat exchange room R1. The inside air of the duct 400 may be discharged to the heat exchange room R1 through the coupling duct 500.

The coupling duct 500 may be connected to the duct 400. For example, the coupling duct 500 may be connected to a duct outlet 420 which will be described below. The coupling duct 500 may be connected to the inside space of the duct 400 through the duct outlet 420.

For example, the coupling duct 500 may include a coupling duct inlet 510 connected to the duct 400. Inside air of the duct 400 may flow into the coupling duct 500 through the coupling duct inlet 510. Air discharged from the duct 400 through the duct outlet 420 may flow into the coupling duct 500 through the coupling duct inlet 510.

For example, the coupling duct inlet 510 may be formed by opening at least one side of the coupling duct 500. The coupling duct inlet 510 may be formed by opening one side of the coupling duct 500 being adjacent to the duct 400.

For example, the coupling duct inlet 510 may have a shape of penetrating one side of the coupling duct 500 in the horizontal direction (Y direction). As shown in FIG. 6, the coupling duct inlet 510 may have a shape of penetrating one side in right direction (+Y direction) of the coupling duct 500 in the horizontal direction (Y direction). Air discharged from the duct 400 may pass through the coupling duct inlet 510 in the horizontal direction (Y direction) and flow into the coupling duct 500.

For example, the coupling duct 500 may be coupled to the duct 400. For example, the duct 400 may include a coupling duct connecting portion 403 connected to the coupling duct 500. A duct outlet 420 which will be described below may be provided in the coupling duct connecting portion 403. The coupling duct connecting portion 403 may penetrate the coupling duct inlet 510 of the coupling duct 500. The coupling duct connecting portion 403 may penetrate the coupling duct inlet 510 to be coupled to the coupling duct 500. Accordingly, at least one portion of the coupling duct connecting portion 403 may be positioned inside the coupling duct 500. This structure may prevent and/or reduce air discharged from the duct 400 from leaking out through a space between the coupling duct connecting portion 403 and the coupling duct inlet 510.

For example, the outdoor unit 10 may further include a sealing member (e.g., including a seal) 600 for sealing a gap between the duct connecting portion 403 and the coupling duct inlet 510. For example, the sealing member 600 may be positioned on an outer circumferential surface of the coupling duct connecting portion 403. For example, the sealing member 600 may be positioned along a circumference of the coupling duct inlet 510. For example, the sealing member 600 may be in contact with an inner surface of the coupling duct 500 in which the coupling duct inlet 510 is formed.

The coupling duct 500 may be connected to the partition 16. For example, the coupling duct 500 may be connected to the partition opening 16*a*. The coupling duct 500 may be connected to the heat exchange room R1 through the partition opening 16*a*.

For example, the coupling duct 500 may include a coupling duct outlet 520 connected to the partition 16. The coupling duct outlet 520 may be provided such that inside air of the coupling duct 500 is discharged to the heat exchange room R1 through the partition 16. The coupling duct outlet 520 may be provided at a position corresponding to the partition opening 16*a*. Inside air of the coupling duct 500 may be discharged to the heat exchange room R1 through the coupling duct outlet 520 and the partition opening 16*a*.

For example, the coupling duct outlet 520 may be formed by opening at least one side of the coupling duct 500. The coupling duct outlet 520 may be formed by opening one side of the coupling duct 500 being adjacent to the partition 16.

For example, the coupling duct outlet 520 may have a shape of penetrating one side of the coupling duct 500 in the horizontal direction (Y direction). As shown in FIGS. 5 and 6, the coupling duct outlet 520 may have a shape of penetrating one side in left direction (−Y direction) of the coupling duct 500 in the horizontal direction (Y direction). Inside air of the coupling duct 500 may be discharged to the heat exchange room R1 by passing through the coupling duct outlet 520 in the horizontal direction (Y direction).

For example, the coupling duct outlet 520 may have a larger size than that of the coupling duct inlet 510, although not limited thereto. However, the size of the coupling duct outlet 520 may be substantially equal to that of the coupling duct inlet 510, or the size of the coupling duct outlet 520 may be smaller than that of the coupling duct inlet 510.

For example, the coupling duct 500 may be coupled to the partition 16. For example, the coupling duct 500 may include a partition coupling portion 501 having a hook shape, and the partition coupling portion 501 may be engaged with the partition 16 by penetrating a duct coupling portion 16*b* formed in the partition 16, although not limited thereto. However, the coupling duct 500 may be coupled to the partition 16 by various methods.

The coupling duct 500 may include a coupling duct flow path 530 formed inside the coupling duct 500. The coupling duct flow path 530 may be positioned between the coupling duct inlet 510 and the coupling duct outlet 520. The coupling duct flow path 530 may extend from the coupling duct inlet 510 to the coupling duct outlet 520.

For example, a size of the coupling duct flow path 530 may be larger than that of the coupling duct inlet 510. For example, a size of a cross-section (a cross-section cut in a X-Z plane) of the coupling duct flow path 530 cut in a direction perpendicular to a flow direction of air may be larger than a size of the coupling duct inlet 510, although not limited thereto. However, the coupling duct flow path 530 may have various sizes.

By this configuration, according to driving of the outdoor fan 13 of the heat exchange room R1, inside air of the machine room R2 may pass through the duct 400 and the coupling duct 500 sequentially and flow into the heat exchange room R1.

For example, the coupling duct 500 may be coupled to the first control box 800. For example, the coupling duct 500 may be coupled to the first control box 800 by screw coupling, etc., although not limited thereto. However, the coupling duct 500 may be coupled to and supported by various components of the outdoor unit 10.

The above-described configuration of the coupling duct 500 may be an example of a structure for connecting the duct 400 to the partition 16, and the disclosure is not limited thereto. The outdoor unit 10 according to the disclosure may include coupling ducts having various structures. The duct 400 may be connected directly to the partition 16, as shown and described in greater detail below with reference to FIG. 15.

Hereinafter, a structure of the duct 400 will be described in greater detail.

The duct 400 may include a duct inlet 410 through which air flows into the duct 400. The duct inlet 410 may allow air to flow into an inside of the duct 400 from the inside space of the machine room R2 outside the duct 400. The duct inlet 410 is configured to introduce air into inside of the duct. The duct inlet 410 is configured to move air into inside of the duct.

The duct inlet 410 may be formed by opening at least one side of the duct 400. The inside space of the machine room R2 may be connected to the inside space (particularly, the duct flow path 430 which will be described below) of the duct 400 through the duct inlet 410.

For example, as shown in FIG. 7, the duct inlet 410 may be provided in a lower portion of the duct 400. For example, as shown in FIG. 7, the duct inlet 410 may have a shape of penetrating the lower portion of the duct 400 in the vertical direction (Z direction). In this case, air of the inside space of the machine room R2 may flow into the inside of the duct 400 by passing through the duct inlet 410 in the vertical direction (Z direction).

The duct 400 may include the duct outlet 420 through which inside air of the duct 400 is discharged to the outside of the duct 400. The duct outlet 420 may allow inside air of the duct 400 to be discharged to the heat exchange room R1. In other words, the duct outlet 420 may discharge air to the heat exchange room R1.

The duct outlet 420 may be formed by opening at least one side of the duct 400. The heat exchange room R1 may be connected to the inside space (specifically, the duct flow path 430 which will be described below) of the duct 400 through the duct outlet 420.

For example, the duct outlet 420 may be formed in one side of the duct 400 being adjacent to the heat exchange room R1. For example, as shown in FIG. 7, the duct outlet 420 may be formed in a left (−Y direction) portion of the duct 400. For example, as shown in FIG. 7, the duct outlet 420 may have a shape of penetrating a side of the duct 400 being adjacent to the heat exchange room R1 in the horizontal direction (Y direction). In this case, air inside the duct 400 may flow into the duct 400 by passing through the duct outlet 420 in the horizontal direction (Y direction).

The duct 400 may include the duct flow path 430. The duct flow path 430 may be formed inside the duct 400. The duct flow path 430 may be provided between the duct inlet 410 and the duct outlet 420. The duct flow path 430 may extend from the duct inlet 420 to the duct outlet 420.

Air may flow inside the duct flow path 430. According to driving of the outdoor fan 13 of the heat exchange room R1, air flowed in through the duct inlet 410 may flow toward the duct outlet 420 along the duct flow path 430, and be discharged to the outside of the duct 400 through the duct outlet 420.

The duct flow path 430 may pass through the heat sink 300. The heat sink 300 may be positioned on the duct flow path 430. Air flowing along the duct flow path 430 may flow along the heat sink 300.

The duct 400 may cover one side of the first control box 800. For example, the duct 400 may cover one side of the first case 810. For example, the duct 400 may be coupled to one side of the first control box 800 at which the heat sink 300 is installed. For example, the duct 400 may cover a side of the first case 810, which is opposite to the side of the first case 810 at which the first case opening 810*a* is formed.

For example, as shown in FIG. 8, the duct flow path 430 may be formed in a space formed between the duct 400 and the first control box 800 as the duct 400 covers one side of the first control box 800. For example, a first flow path 431, a second flow path 432, and a third flow path 433, which will be described in greater detail below, may be formed in the space formed between the duct 400 and the first control box 800 as the duct 400 covers one side of the first control box 800.

The duct 400 may be coupled to the first control box 800. The duct 400 may be coupled to one side of the first control box 800. For example, the duct 400 may be coupled to one side of the first control box 800 on which the heat sink 300 is mounted. For example, the duct 400 may be coupled to a side of the first case 810, which is opposite to another side in which the first case opening 810*a* is formed. For example, the duct 400 may be coupled to one side of the first control box 800 in the rear direction (−X direction).

The duct 400 may include a first control box coupling portion 401 coupled to the first control box 800. For example, the first control box coupling portion 401 may be coupled to one side of the first control box 800 in the rear direction (−X direction). For example, the first control box coupling portion 401 may be coupled to one side of the first case 810 in the rear direction (−X direction).

The first control box coupling portion 401 may be coupled to the first case 810 by various methods such as screw coupling.

For example, the duct 400 may be connected to an inside space of the first control box 800, that is, the first accommodating space 811. For example, the duct flow path 430 may be connected to the first accommodating space 811. The duct 400 may include a first control box connecting hole 401*a* formed to connect the duct flow path 430 to the first accommodating space 811. A first duct connecting hole 813 corresponding to the first control box connecting hole 401*a* may be formed in the first case 810.

Because the duct flow path 430 is connected to the first accommodating space 811, a refrigerant gas flowed into the first accommodating space 811 according to driving of the outdoor fan 13 of the heat exchange room R1 may be discharged to the duct flow path 430 and flow into the heat exchange room R1. Because the duct flow path 430 is connected to the first accommodating space 811, internal heat of the first control box 800 may be more efficiently discharged through the duct flow path 430.

For example, the first control box connecting hole 401*a* may be provided in the first control box coupling portion 401 of the duct 400. The first control box connecting hole 401*a* may have a shape of penetrating the first control box coupling portion 401.

For example, the first duct connecting hole 813 may be formed in one side of the first case 810 in the rear direction (−X direction).

For example, the duct 400 may cover one side of the second control box 900. For example, the duct 400 may cover one side of the second case 910. For example, the duct 400 may cover a side of the second case 910, which is opposite to another side of the second case 910 in which the second case opening 910*a* is formed.

For example, as shown in FIG. 8, because the duct 400 covers one side of the second control box 900, the duct flow path 430 may be formed in a space between the duct 400 and the second control box 900. For example, because the duct 400 covers one side of the second control box 900, a fourth flow path 434 which will be described in greater detail below may be formed in the space between the duct 400 and the second control box 900.

The duct 400 may be coupled to the second control box 900. The duct 400 may be coupled to one side of the second control box 900. For example, the duct 400 may be coupled to a side of the second case 910, which is opposite to another side of the second case 910 in which the second case opening 910*a* is formed. For example, the duct 400 may be coupled to a portion of the second control box 900 in the left direction (−Y direction).

The duct 400 may include a second control box coupling portion 402 coupled to the second control box 900. For example, the second control box coupling portion 402 may be coupled to a left (−Y direction) portion of the second control box 900. For example, the second control box coupling portion 402 may be coupled to a left (−Y direction) portion of the second case 910.

The second control box coupling portion 402 may be coupled to the second case 910 by various methods such as screw coupling.

For example, the duct 400 may be connected to an inside space of the second control box 900, that is, the second accommodating space 911. For example, the duct flow path 430 may be connected to the second accommodating space 911. One side of the second control box coupling portion 402, which covers the second control box 900, may open. The second case 910 may include a second duct connecting hole 913 (see FIG. 12) connecting the duct flow path 430 to the second accommodating space 911. Because the second control box coupling portion 402 covers the second duct connecting hole 913, the duct flow path 430 may be connected to the second accommodating space 911.

Because the duct flow path 430 is connected to the second accommodating space 911, a refrigerant gas flowed into the second accommodating space 911 according to driving of the outdoor fan 13 of the heat exchange room R1 may be discharged to the duct flow path 430 and flow into the heat exchange room R1. Also, because the duct flow path 430 is connected to the second accommodating space 911, internal heat of the second control box 900 may be discharged through the duct flow path 430.

For example, the second duct connecting hole 913 (see, e.g., FIG. 12) may be formed in a left (−Y direction) portion of the second case 910.

Figure 9:
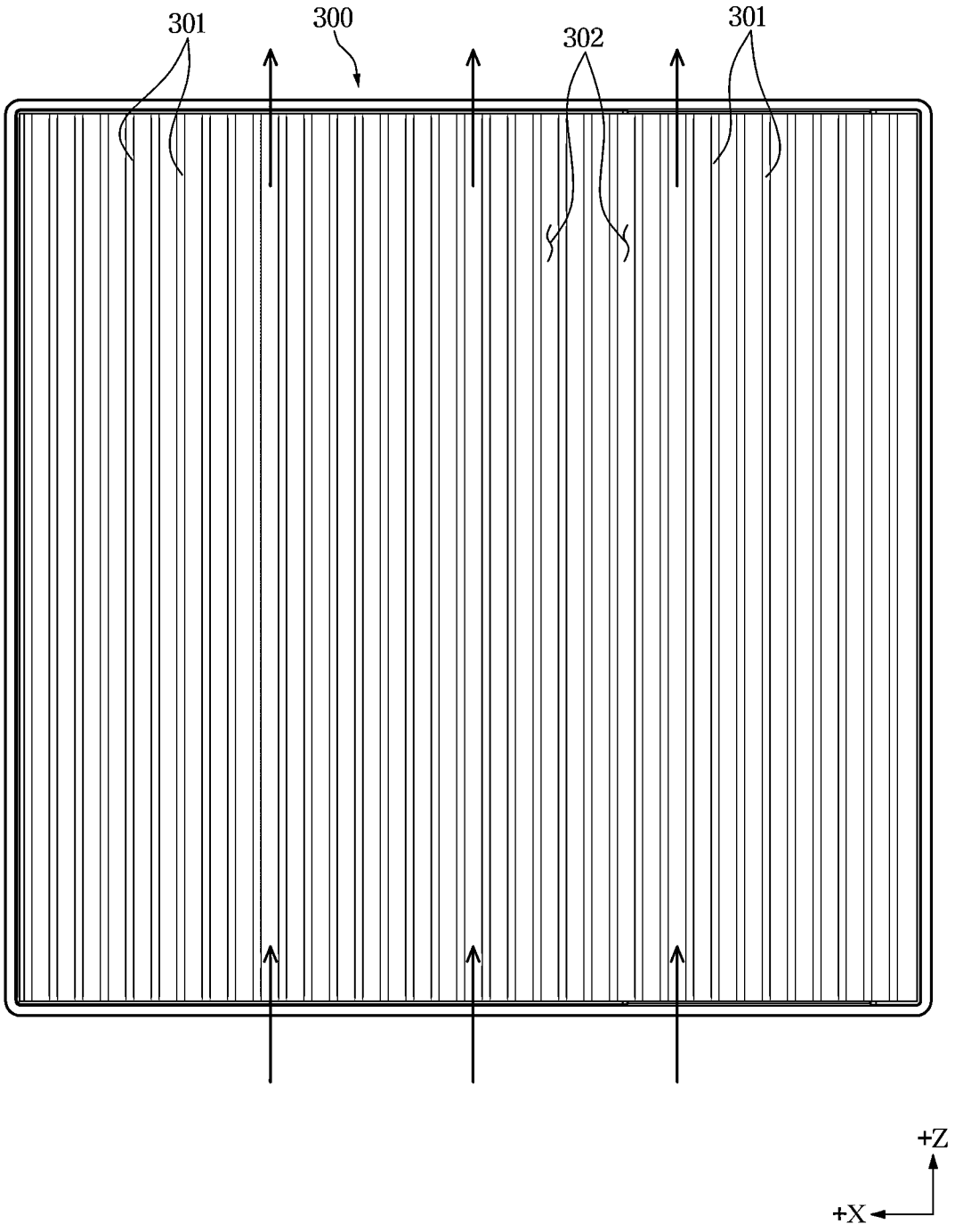
FIG. 9 is a diagram illustrating an enlarged view of a heat sink of an outdoor unit of an air conditioner according to various embodiments.

FIG. 9 is an diagram illustrating a heat sink of an outdoor unit of an air conditioner according to various embodiments.

Referring to FIG. 9, the heat sink 300 of the outdoor unit 10 of the air conditioner 1 according to an embodiment of the disclosure may exchange heat with air that passes through the heat sink 300 substantially in one direction. For example, the heat sink 300 may receive heat generated in the first PCB 81, and transfer the heat to air that passes through the heat sink 300 substantially in one direction. A flow direction of air passing through the heat sink 300 is defined as a first direction Z The heat sink 300 may extend along the first direction Z. For example, the heat sink 300 may extend along the vertical direction Z of the outdoor unit 10.

For example, the heat sink 300 may include a plurality of heat transfer plates 301. The plurality of heat transfer plates 301 may be positioned inside the duct 400. The plurality of heat transfer plates 301 may be covered by the duct 400. The duct flow path 430 may pass through the plurality of heat transfer plates 301.

Each of the heat transfer plates 301 may be formed in a plate shape made of a material (for example, metal) with high thermal conductivity. Each of the heat transfer plates 301 may transfer internal heat of the first control box 800 to inside air of the duct 400.

Each of the heat transfer plates 301 may extend from a side being adjacent to the first PCB 81. For example, each of the heat transfer plates 301 may extend from the side being adjacent to the first PCB 81 in the second direction X. For example, each of the heat transfer plates 301 may extend from the side being adjacent to the first PCB 81 in the rear direction (−X direction).

Each of the heat transfer plates 301 may extend in the first direction Z. For example, the heat transfer plates 301 may extend with a longer length in the first direction Z. The first direction Z may be substantially orthogonal to the second direction X in which the heat transfer plates 301 extend from the side adjacent to the first printed circuit board 81.

The plurality of heat transfer plates 301 may be arranged along the third direction Y in such a way as to be spaced apart from each other. For example, the direction (the first direction Z or the second direction X) in which the heat transfer plates 301 extend may be substantially orthogonal to the direction (the third direction Y) in which the plurality of heat transfer plates 301 are arranged. For example, the heat transfer plates 301 may be substantially orthogonal to the direction in which the plurality of heat transfer plates 301 are arranged.

However, on the other hand, the first direction Z, the second direction X, and the third direction Y described above may not be orthogonal to each other.

A heat transfer flow path 302 may be formed between the plurality of heat transfer plates 301 spaced apart from each other. In other words, the heat transfer flow path 302 may be formed between a pair of neighboring heat transfer plates 301 among the plurality of heat transfer plates 301. Air may flow through the heat transfer flow path 302. That is, the plurality of heat transfer plates 301 may exchange heat with air flowing along the heat transfer flow path 302. The heat transfer flow path 302 may form a portion of the duct flow path 430.

The heat transfer flow path 302 may extend along the first direction Z. For example, air flowing along the heat transfer flow path 302 may flow in the first direction Z and exchange heat with the plurality of heat transfer plates 301. Air flowed into the heat transfer flow path 302 from one side of the heat sink 300 in the first direction Z may flow along the first direction Z to exchange heat with the heat sink 300, and escape from the heat sink 300 at another side of the heat sink 300 in the first direction Z. For example, as shown in FIG. 9, air passing through the heat sink 300 may flow into the heat transfer flow path 302 from a lower end of the heat sink 300, flow upward (+Z direction) along the heat transfer flow path 302, exchange heat with the plurality of heat transfer plates 301, and escape from the heat transfer flow path 302 at an upper end of the heat sink 300.

As such, the heat sink 300 may include the plurality of heat transfer plates 301, and according to the heat transfer flow path 302 being formed between the plurality of heat transfer plates 301, a heat transfer area of the heat sink 300 may be widened, and thus, heat dissipation efficiency may be improved.

Figure 10:
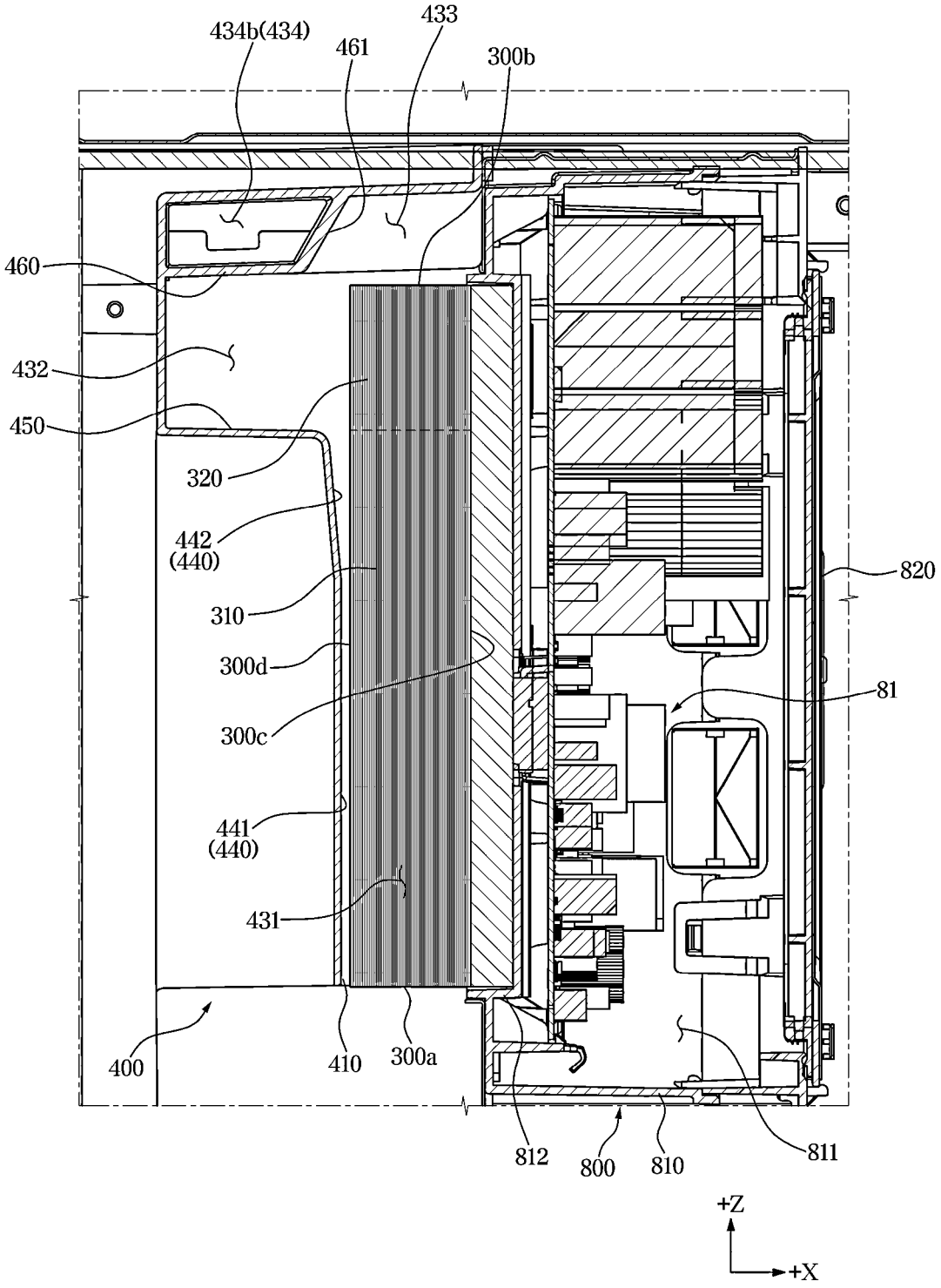
FIG. 10 is a cross-sectional view illustrating various components of an outdoor unit of an air conditioner according to various embodiments.
Figure 11:
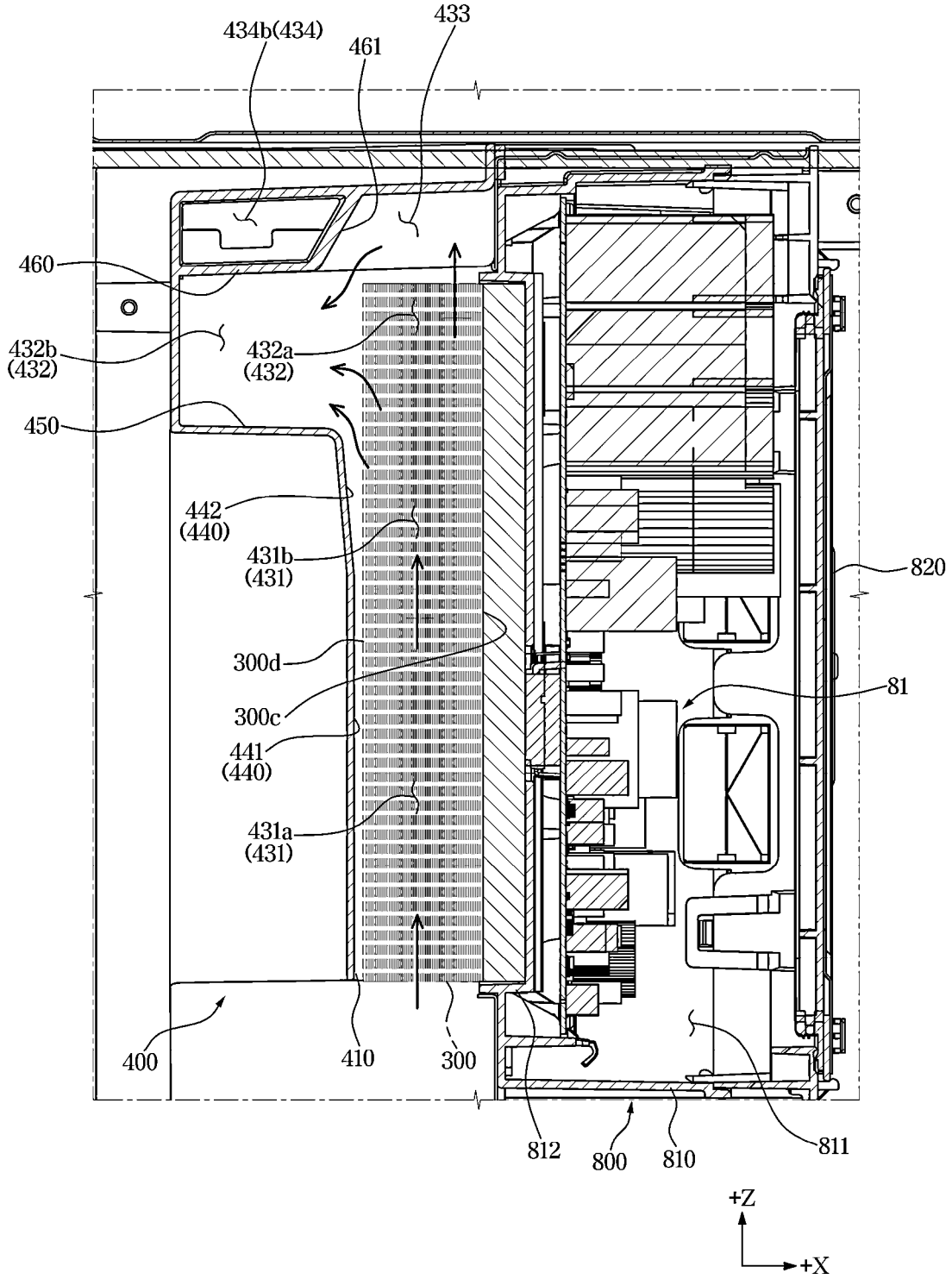
FIG. 11 is a cross-sectional view illustrating various components of an outdoor unit of an air conditioner according to various embodiments.
Figure 12:
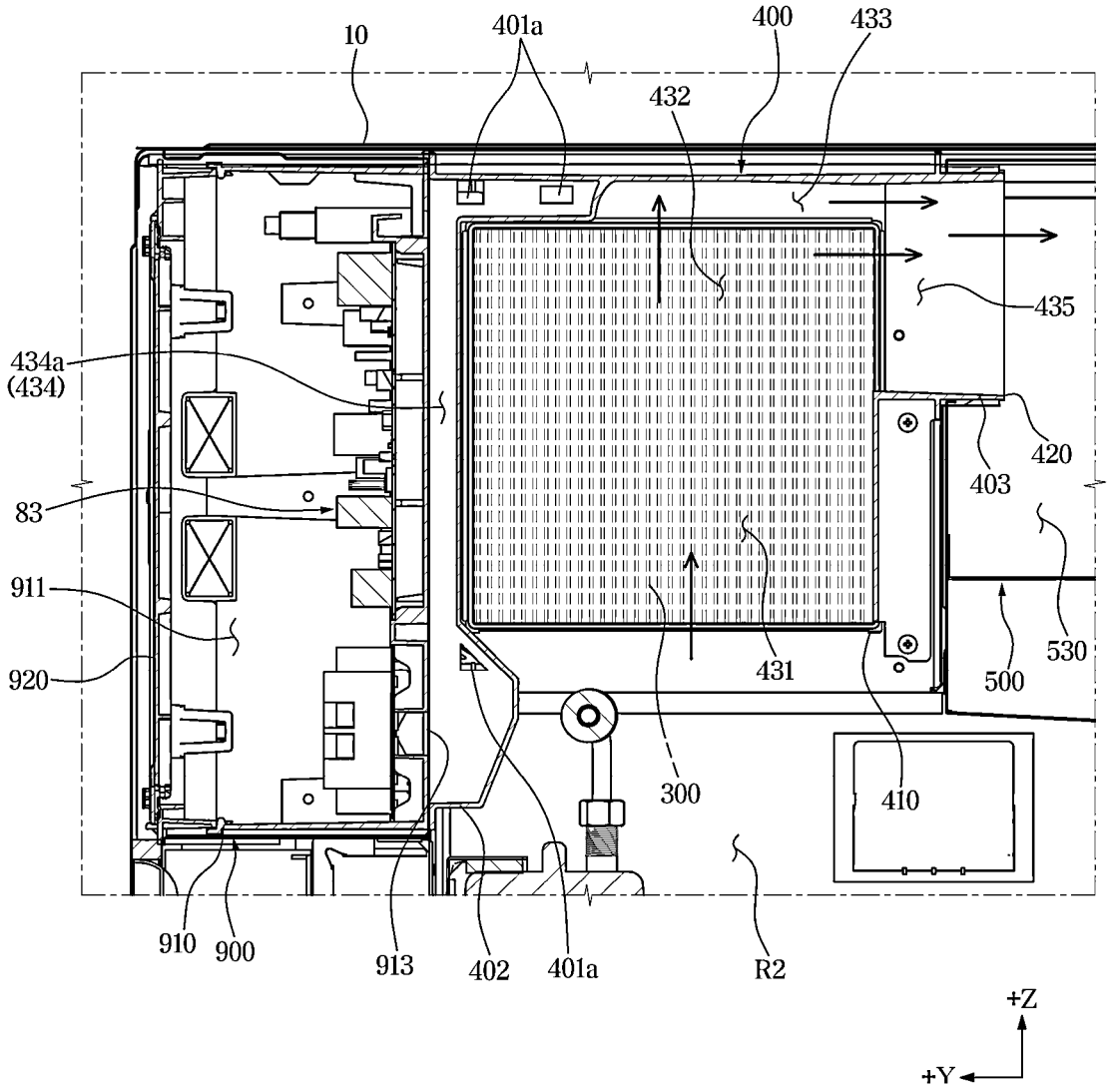
FIG. 12 is a cross-sectional view illustrating various components of an outdoor unit of an air conditioner according to various embodiments.
Figure 13:
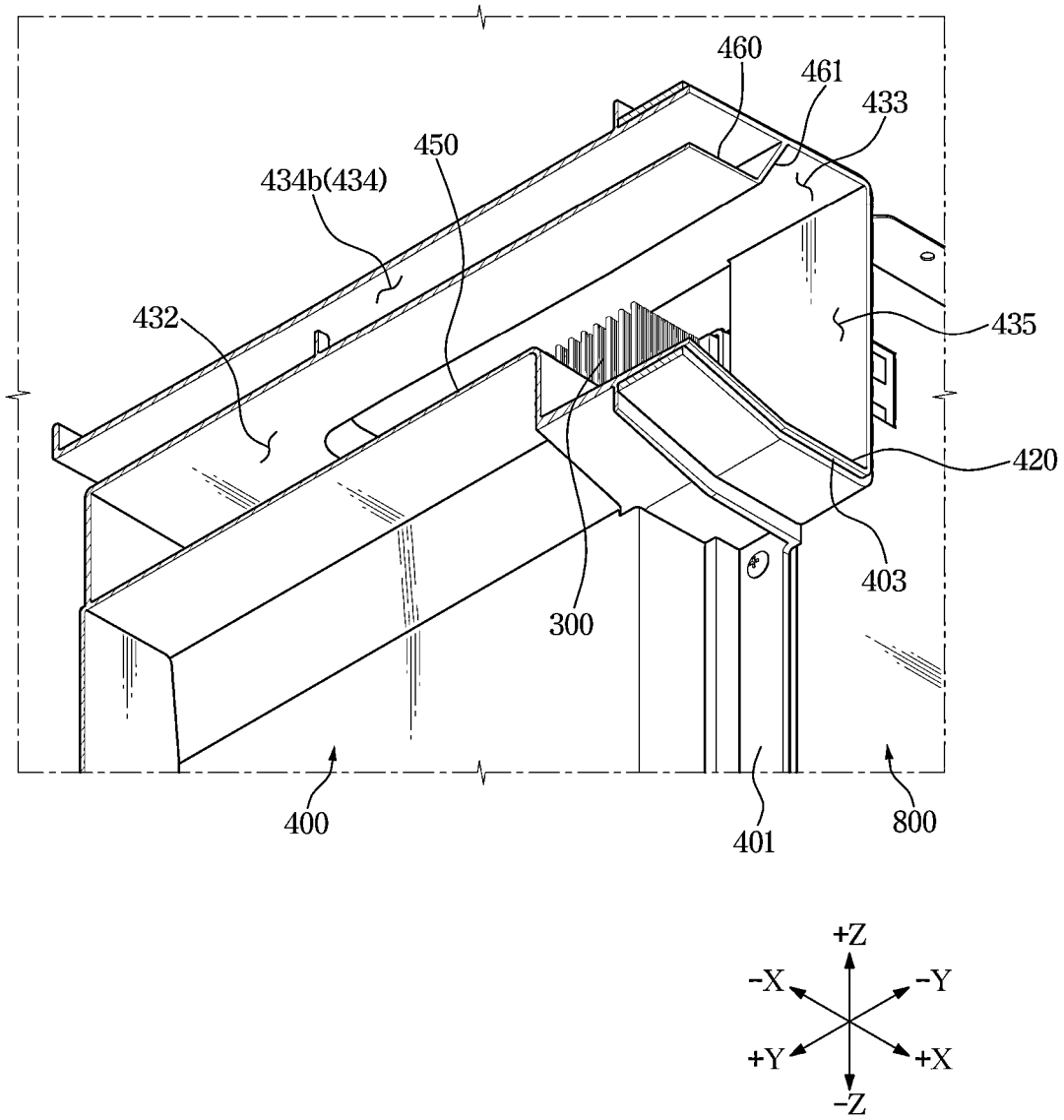
FIG. 13 is a cross-sectional perspective view illustrating various components of an outdoor unit of an air conditioner according to various embodiments.

FIG. 10 is a cross-sectional view illustrating various components of an outdoor unit of an air conditioner according to various embodiments. FIG. 11 is a cross-sectional view illustrating various components of an outdoor unit of an air conditioner according to various embodiments. FIG. 12 is a cross-sectional view illustrating various components of an outdoor unit of an air conditioner according to various embodiments. FIG. 13 is a cross-sectional perspective view illustrating various components of an outdoor unit of an air conditioner according to various embodiments.

Referring to FIGS. 10, 11, 12 and 13 (which may be referred to as FIGS. 10 to 13), the duct flow path 430 formed inside the duct 400 of the outdoor unit 10 of the air conditioner 1 according to an embodiment of the disclosure may include a portion extending in the first direction Z, and a portion extending in the second direction Y.

As described above, the first control box 800 may be positioned such that the first case opening 810*a* and the first case cover 820 are toward the front direction (+X direction) of the housing 100. Also, the heat sink 300 may be mounted on a rear portion of the first control box 800.

Likewise, as described above, the second control box 900 may be positioned such that the second case opening 910*a* and the second case cover 920 are toward the right direction (+Y direction) of the housing 100. As shown, the second control box 900 may be positioned in the right direction (+Y direction) from the first control box 800, and the heat sink 300 may be positioned in the left direction (−Y direction) from the second control box 900. In this case, in the case in which the heat sink 300 is positioned such that the heat transfer flow path 302 extends along the horizontal direction (Y direction), the second control box 900 and the heat sink 300 may need to be arranged with a sufficient spacing distance in the horizontal direction (Y direction) therebetween to secure a space into which air flows at one side of the heat transfer flow path 32. Accordingly, a length of the machine room R2 in the horizontal direction (Y direction) may increase, and an entire product size may increase.

For the same reason, the heat sink 300 may extend such that the heat transfer path 302 extends along the vertical direction (Z direction). In other words, the heat sink 300 may allow air to pass therethrough in the vertical direction (Z direction).

For various reasons, the heat sink 300 may be positioned such that the heat transfer flow path 302 extends along the vertical direction (Z direction).

Each of components of the duct flow path 430 may have a preset width in the front-rear direction (X direction) inside the duct 400. As described above, the heat sink 300 may extend from the side being adjacent to the first PCB 81. For example, each of the plurality of heat transfer plates 301 included in the heat sink 300 may extend in the rear direction (−X direction) from the side being adjacent to the first PCB 81. For example, each of the plurality of heat transfer plates 301 may extend in the front-rear direction (X direction). Accordingly, a part of the duct flow path 430, at least passing through the plurality of heat transfer plates 301, may have a width that at least corresponds to or is larger than a width of each of the plurality of heat transfer plates 301 in the front-rear direction (X direction).

Because the heat exchange room R1 and the machine room R2 are arranged in the horizontal direction (Y direction), air flowed through the heat sink 300 in the vertical direction (Z direction) may flow in the horizontal direction (Y direction) and be discharged into the heat exchange room R1. Accordingly, inside the duct 400, the duct flow path 430 may include a vertical flow path extending in the vertical direction (Z direction) such that air passes through the heat sink 300 in the vertical direction (Z direction), and a horizontal flow path extending in the horizontal direction (Y direction) such that the air escaped from the heat sink 300 flows in the horizontal direction (Y direction) toward the heat exchange room R1.

Hereinafter, a direction in which the heat sink 300 extends along the heat exchange room 302 may be referred to as the first direction Z. In other words, the heat sink 300 may be positioned such that air passes through the heat sink 300 in the first direction Z. The heat sink 300 may extend along the first direction Z. The part of the duct flow path 430 in which air passes through the heat sink 300 in the first direction Z may extend along the first direction Z. As described above, the first direction Z may include the vertical direction Z of the outdoor unit 10, although not limited thereto. The first direction in which the heat transfer flow path 302 of the heat sink 300 extends may include a direction inclined with respect to the vertical direction of the outdoor unit 10.

In addition, hereinafter, a width direction of each component of the duct flow path 430 inside the duct 400 may be referred to as the second direction X. The second direction X may be different from the first direction Z in which air passes through the heat sink 300. Also, the second direction X may be a direction that is parallel to the direction in which the heat sink 300 extends from the side (or the side being adjacent to the first PCB 81) being adjacent to the first control box 800. In other words, the second direction X may be a direction that is parallel to the direction in which each of the plurality of heat transfer plates 301 extends from the side (or the side being adjacent to the first PCB 81) being adjacent to the first control box 800. For example, the second direction X may be a direction that is orthogonal to the first direction Z in which the air passes through the heat sink 300. As described above, the second direction X may include the front-rear direction X of the outdoor unit 10, although not limited thereto. However, the second direction which is a width direction of the duct flow path 430 may be a direction inclined with respect to the front-rear direction X of the outdoor unit 10. Also, the second direction which is the width direction of the duct flow path 430 may not be the direction that is orthogonal to the first direction Z.

In addition, hereinafter, a direction in which a part of the duct flow path 430 extends such that air escaped from the heat sink 300 flows toward the heat exchange room R1 may be referred to as the third direction Y. In other words, a part of the duct flow path 430 may extend along the first direction Z, and another part of the duct flow path 430 may extend along the third direction Y. The third direction Y may be a direction that is different from the first direction Z and the second direction X. For example, the third direction Y may be a direction that is orthogonal to the first direction Z. Also, for example, the third direction Y may be a direction that is orthogonal to the second direction X. As described above, the third direction (Y direction) may include the horizontal direction Y of the outdoor unit 10, although not limited thereto. However, the third direction in which a part of the duct flow path 430 extends such that air escaped from the heat sink 300 flows toward the heat exchange room R1 may include a direction inclined with respect to the horizontal direction of the outdoor unit 10. The third direction in which a part of the duct flow path 430 extends such that air escaped from the heat sink 300 flows toward the heat exchange room R1 may not be the direction that is orthogonal to the first direction Z and the second direction X.

The duct 400 may include the first flow path 431 extending from the duct inlet 410. The first flow path 431 may construct a part of the duct flow path 430. More specifically, the first flow path 431 may extend from the duct inlet 410 in the first direction Z. The first flow path 431 may allow air flowed in through the duct inlet 410 to flow along the first direction Z. For example, the first flow path 431 may allow air flowed in through the duct inlet 410 to flow upward (+Z direction).

A part of the heat sink 300 may be positioned in the first flow path 431. More specifically, a first part 310 of the heat sink 300, which is adjacent to the duct inlet 410, may be positioned in the first flow path 431. The first flow path 431 may extend in the first direction Z along the first part 310 of the heat sink 300. The first flow path 431 may allow air flowed in through the duct inlet 410 to flow along the first part 310 of the heat sink 300.

For example, the first flow path 431 may extend from a location that is substantially parallel to one side 300*a* of the heat sink 300 in the first direction Z. In this case, the one side 300*a* of the heat sink 300 in the first direction Z may be one side of the heat sink 300, which is adjacent to the duct inlet 410.

The duct 400 may include the second flow path 432 connecting the first flow path 431 to the duct outlet 420. The second flow path 432 may include a part of the duct flow path 430. For example, the second flow path 432 may be positioned in the first direction Z with respect to the first flow path 431. The second flow path 432 may extend along the third direction Y that is different from the first direction Z, toward the duct outlet 420. The second flow path 432 may allow air transferred from the first flow path 431 to flow in the third direction Y toward the duct outlet 420. For example, the third direction Y in which the second flow path 432 extends may be substantially orthogonal to the first direction Z in which the first flow path 431 extends. For example, the second flow path 432 may extend along the horizontal direction Y toward the duct outlet 420, although not limited thereto. However, the third direction Y in which the second flow path 432 extends and the first direction Z in which the first flow path 431 extends may have an angle other than 90 degrees.

A part of the heat sink 300 may be positioned in the second flow path 432. More specifically, a second part 320 of the heat sink 300 may be positioned in the second flow path 432. The second part 320 of the heat sink 300 may include a part extending from the first part 310 in the first direction Z. For example, the second part 320 of the heat sink 300 may include a part extending upward (+Z direction) from the first part 310.

By this structure, air flowed into the duct 400 through the duct inlet 410 may flow in the first direction Z along the first flow path 431, exchange heat with the first part 310 of the heat sink 300, further flow in the first direction Z along the second flow path 432, exchange heat with the second part 320 of the heat sink 300, then flow in the third direction Y along the second flow path 432, and arrive at the duct outlet 420.

According to the first flow path 431 having an excessively large width in the second direction X, air may not sufficiently arrive at the second part 320 of the heat sink 300. For example, according to a width of the first flow path 431 in the second direction X being excessively large compared to a width of the heat sink 300 in the second direction X, air flowed into the first flow path 431 and flowing along the heat transfer flow path 302 of the heat sink 300 may escape from the heat transfer flow path 302 before arriving at the second part 320 of the heat sink 300. Because the plurality of heat transfer plates 301 extend from the side being adjacent to the first PCB 81 in the first direction X, while being spaced apart from each along the third direction Y, the heat transfer flow path 302 may be closed at one side 300*c* in the second direction X, being adjacent to the first PCB 81, and opened at another side 300*d* in the second direction X, which is opposite to the one side. A part of air flowing along the heat transfer flow path 302 may escape from the heat transfer flow path 302 through the other side 300*d* in the second direction X. Accordingly, in the case in which a major part of air flowing along the heat transfer flow path 302 fails to escape from the heat transfer flow path 302 through the other side 300*d* in the second direction and arrive at the second part 320 of the heat sink 300, heat exchange may not occur efficiently in the second part 320 of the heat sink 300, and internal heat of the first control box 80 may not be efficiently discharged.

To address this issue, a width of the first flow path 431 in the second direction X may be similar to the width of the first portion 310 of the heat sink 300 in the second direction X, or may be at least not excessively large compared to the width of the first portion 310 of the heat sink 300 in the second direction X. Furthermore, a width of the first flow path 431 in the second direction X may substantially correspond to a width X of the first part 310 of the heat sink 300 in the second direction. Because the width of the first flow path 431 is relatively not large, air flowing along the first part 310 of the heat sink 300 may be effectively prevented/inhibited from escaping from the first part 310. In addition, according to the first flow path 431 having a small width, flow velocity of air flowing along the first flow path 431 may increase, and thus, air may efficiently arrive at the second part 320 of the heat sink 300.

The duct 400 may include a cover wall 440. The cover wall 440 may cover the first part 310 of the heat sink 310. The cover wall 440 may cover the first part 310 of the heat sink 310 in the second direction X. The cover wall 440 may cover the first flow path 431 in the second direction X. The cover wall 440 may form the first flow path 431. The cover wall 440 may cover another side 300*d* of the first part 310 of the heat sink 300 in the second direction X. The cover wall 440 may prevent and/or reduce air from escaping from the first part 310 of the heat sink 300 and guide the air to efficiently arrive at the second part 320 of the heat sink 300.

By this structure of the first flow path 431, air flowing along the heat sink 300 may be prevented/reduced from escaping from the first part 310 and efficiently flow toward the second part 320 of the heat sink 300 along the first direction Z. That is, by this structure of the first flow path 431, air flowed into the one side 300*a* of the heat sink 300 in the first direction Z may efficiently flow up to the other side 300*b* of the heat sink 300 in the first direction Z.

A width of the second flow path 432 in the second direction X may be larger than the width of the first flow path 431 in the second direction X. More specifically, the second flow path 432 may include a first part 432*a* located to one side of the first flow path 431 in the first direction Z, and a second part 432*b* located to one side of the first part 432*a* in the second direction X. The first part 432*a* of the second flow path 432 may extend from the first flow path 431 in the first direction Z, and the second part 432*b* may extend from the first part 432*a* in the second direction Z. The second part 320 of the heat sink 300 may be positioned in the first part 432*a* of the second flow path 432. The first part 432*a* may be positioned between the first flow path 431 and the third flow path 433 which will be described below, in the first direction Z.

In the first part 432*a* of the second flow path 432, a major part of air may flow along the first direction Z. However, due to the arrangement of the plurality of heat transfer plates 301, it may be nearly impossible that air flows along the third direction Y. Accordingly, the second flow path 432 may include the second part 432*b* which has a larger width in the second direction X than the first flow path 431 and in which the heat transfer plates 301 are not positioned such that air flows in the third direction Y. Therefore, air may efficiently flow toward the duct outlet 420 in the third direction Y. That is, in the first part 432*a* of the second flow path 432, heat exchange may occur between air and the heat sink 300, and in the second part 432*b* of the second flow path 432, air escaped from the heat sink 300 may flow toward the duct outlet 420.

In addition, because the second flow path 432 has a larger width in the second direction X than the first flow path 431, the second flow path 432 may secure a large flow path area, reduce flow resistance of air, and increase a flow rate of air.

The duct 400 may include an extension wall 450. The extension wall 450 may extend from the cover wall 440. The extension wall 450 may extend in a direction that is different from a direction in which the cover wall 440 extends.

For example, the extension wall 450 may extend from one end of the cover wall 440, which is opposite to the duct inlet 410, in the second direction X. That is, as shown in the drawings, the extension wall 450 may extend from an upper end of the cover wall 440 in the rear direction (−X direction).

The second flow path 432 may be positioned in the first direction (Z direction) with respect to the extension wall 450. For example, the second part 432*b* of the second flow path 432 may be positioned in the first direction (Z direction) with respect to the extension wall 450. For example, as shown in the drawings, the extension wall 450 may form a lower surface of the second part 432*b* of the second flow path 432.

By this structure of the first flow path 431 and the second flow path 432, heat transfer efficiency between the heat sink 300 and air may be improved, and heat dissipation efficiency of the heat sink 300 may be improved.

For example, a length of the first flow path 431 in the first direction Z may be longer than a length of the second flow path 432 in the first direction Z.

The first flow path 431 may include a first part 431*a* being adjacent to the duct inlet 410, and a second part 431*b* positioned to one side of the first part 431*a* in the first direction Z. The second part 431*b* of the first flow path 431 may be positioned between the first part 431*a* and the second flow path 432. The second part 431*b* of the first flow path 431 may extend from the first part 431*a* toward the second flow path 432.

In this case, a width of the second part 431*b* of the first flow path 431 in the second direction X may increase toward the second flow path 432 from the first part 431*a*. However, the first part 431*a* of the first flow path 431 may have a substantially constant width in the second direction X.

In correspondence to the shape of the first flow path 431, the cover wall 440 may include an inclined portion 442 extending to become farther away from the heat sink 300 in the second direction X while nearing the second flow path 432 from the first flow path 431 in the first direction Z. The inclined portion 442 may correspond to the second part 431*b* of the first flow path 431. The inclined portion 442 may guide a flow of air such that air flowing along the first flow path 431 efficiently flows toward the second part 432*b* of the second flow path 432. In contrast, the cover wall 440 may include a flat portion 441 that extends in a direction substantially parallel to the first direction Z. For example, the inclined portion 442 may extend in a direction that is inclined from the flat portion 441 in the first direction Z.

By this structure of the first flow path 431, air flowing along the first flow path 431 may be guided to flow to the second part 432*b* of the second flow path 432. In addition, by this structure of the first flow path 431, air may smoothly flow inside the entire duct flow path 430, although not limited thereto.

However, the first flow path 431 may have a constant width.

According to an embodiment of the disclosure, the duct 400 may further include the third flow path 433. The third flow path 433 may include a part of the duct flow path 430. The third flow path 433 may be provided in the first direction Z from the one side 300*b* of the heat sink 300, which is opposite to the duct inlet 410. The third flow path 433 may be formed to one side (one side in the upper direction (+Z direction) as shown) of the second part 320 of the heat sink 300 in the first direction Z. The third flow path 433 may be positioned in the first direction Z with respect to the first part 432*a* of the second flow path 432. The third flow path 433 may extend in the first direction Z from the first part 432*a* of the second flow path 432.

Because the third flow path 433 is formed, air flow resistance may be prevented/reduced in the other side 300*b* of the heat sink 300 in the first direction Z, and air passing through the heat sink 300 in the first direction Z may flow more smoothly.

For example, the length of the first flow path 431 in the first direction Z may be longer than a length of the third flow path 433 in the first direction Z. Also, for example, the length of the second flow path 432 in the first direction Z may be longer than the length of the third flow path 433 in the first direction Z.

The third flow path 433 may extend along the third direction Y. More specifically, the third flow path 433 may extend along the third direction Y toward the duct outlet 420. By this structure, at least a part of air escaped from the heat sink 300 in the first direction Z may flow toward the duct outlet 420 along the third flow path 433.

A width of the third flow path 433 in the second direction X may be smaller than the width of the second flow path 432 in the second direction X. Therefore, air may be prevented/reduced from being unnecessarily diffused and flowing in the third flow path 433 positioned in the third direction Z with respect to the heat sink 300.

The duct 400 may include a fourth flow path 434 extending from the second control box 900 toward the duct outlet 420, which will be described below. The fourth flow path 434 may be partitioned from the second flow path 432 and the fourth flow path 433. In this case, at least one part of the fourth flow path 434 may be positioned in the first direction Z with respect to the second flow path 432 and in the second direction X with respect to the third flow path 433. As shown in the drawings, at least one part 434*b* of the fourth flow path 434 may be positioned in the upper direction (+Z) with respect to the second part 432*b* of the second flow path 432 and in the rear direction (−X) with respect to the third flow path 433. By this structure, a width of the third flow path 433 in the second direction X may become smaller than a width of the second flow path 432 in the second direction X.

The third flow path 433 may be connected to the second flow path 432. In this case, a part of air of the third flow path 433 may flow toward the second flow path 432. Therefore, a part of air flowed into the third flow path 433 from the heat sink 300 may again flow into the second flow path 432 and flow along the second flow path 432, and another part of the air may flow along the third flow path 433.

The duct 400 may include a flow path guide 461 that guides air in the third flow path 433 to flow from the third flow path 433 toward the second flow path 432. The flow path guide 461 may be provided at one side of the third flow path 433. For example, the flow path guide 461 may be provided at one side of the third flow path 433 in the second direction X. As shown in the drawings, the flow path guide 461 may be provided at a rear portion (−X direction) of the third flow path 433.

For example, the flow path guide 461 may be inclined in such a way as to become closer to the second flow path 432 in the first direction Z as being more distant from the third flow path 433 in the second direction X. As shown in the drawings, the flow path guide 461 may be inclined in such a way as to extend in the rear direction (−X) toward the lower direction (−Z).

For example, the flow path guide 461 may include at least one portion of a flow path partition wall 460 which will be described below.

By this structure, a width of the third flow path 433 in the second direction X may increase as the third flow path 433 becomes closer to the second flow path 432 in the first direction Z. As shown in the drawings, a width of the third flow path 433 in the front-rear direction X may be larger at the lower position of the third flow path 433 (−Z direction).

By this structure, internal air of the third flow path 433 may efficiently flow to the second flow path 432.

According to an embodiment of the disclosure, the duct 400 may further include a connection flow path 435. The connection flow path 435 may include a part of the duct flow path 430. The connection flow path 435 may connect the second flow path 432 to the duct outlet 420. Also, the connection flow path 435 may connect the third flow path 433 to the duct outlet 420. For example, the duct outlet 420 may be provided at one end of the connection flow path 435 in the third direction Y.

For example, a width of the connection flow path 435 in the first direction Z may be larger than a width of the second flow path 432 in the first direction Z. For example, a width of the connection flow path 435 in the first direction Z may be larger than a width of the third flow path 433 in the first direction Z.

For example, a width of the connection flow path 435 in the second direction X may be larger than a width of the first flow path 341 in the second direction X. For example, the width of the connection flow path 435 in the second direction X may be larger than a width of the third flow path 433 in the second direction X. For example, the width of the connection flow path 435 in the second direction X may substantially correspond to a width of the second flow path 432 in the second direction X.

For example, the connection flow path 435 may be formed inside the coupling duct connecting portion 403 described above. The coupling duct connecting portion 403 may be provided along a circumference of the duct flow path 430.

Figure 14:
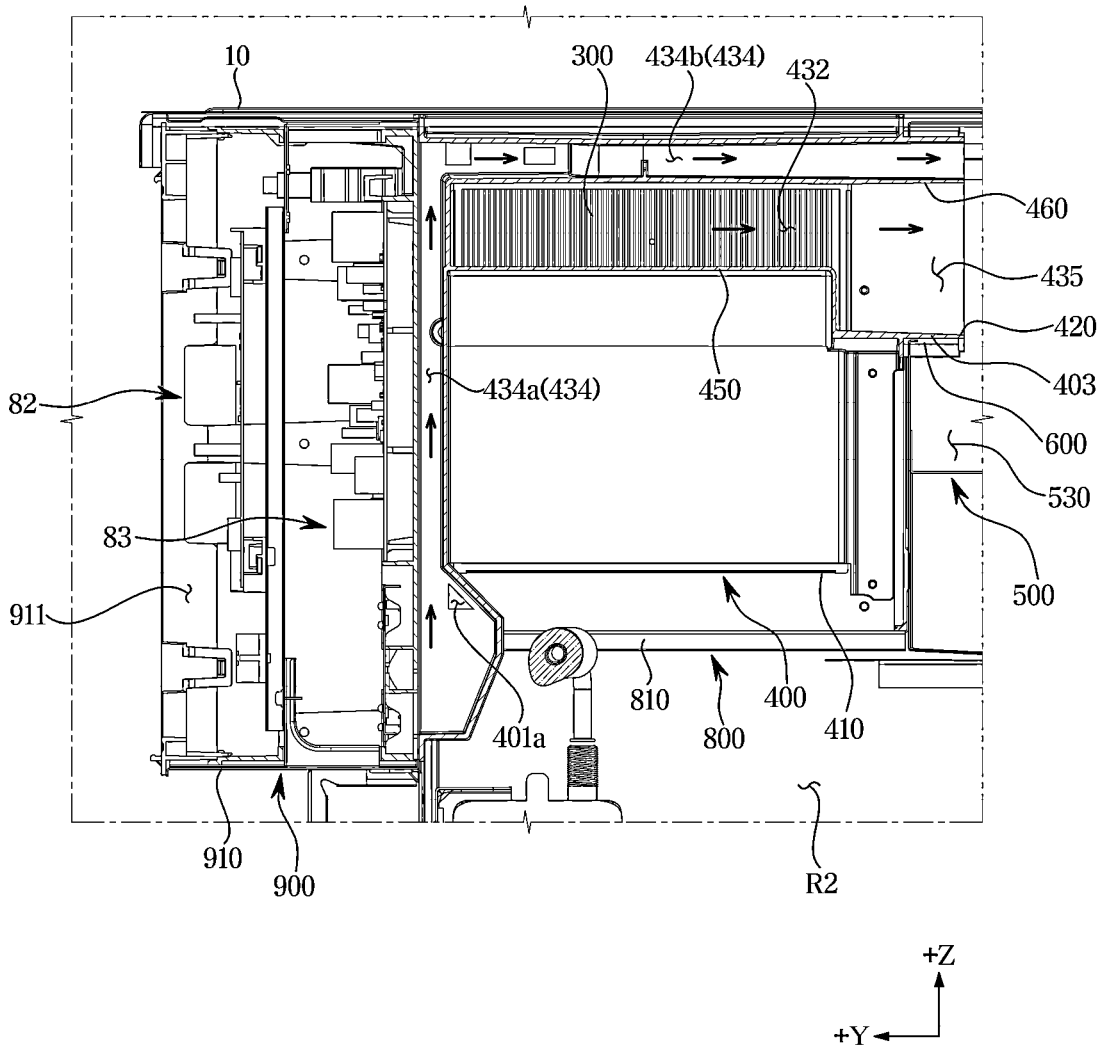
FIG. 14 is a cross-sectional view illustrating various components of an outdoor unit of an air conditioner according to various embodiments.

FIG. 14 is a cross-sectional view illustrating various components of an outdoor unit of an air conditioner according to various embodiments.

Referring to FIG. 14, the duct 400 of the outdoor unit 10 of the air conditioner 1 according to an embodiment of the disclosure may include a fourth flow path 434. The fourth flow path 434 may be formed inside the duct 400. The fourth flow path 434 may be covered by the duct 400. The fourth flow path 434 may include a part of the duct flow path 430.

For example, the fourth flow path 434 may be connected to the second control box 900. The fourth flow path 434 may connect the second control box 900 to the duct outlet 420. The fourth flow path 434 may extend from the second control box 900 toward the duct outlet 420. The fourth flow path 434 may discharge heat generated inside the second control box 900 through the duct outlet 420. The fourth flow path 434 may discharge a refrigerant gas flowed into the second case 910 through the duct outlet 420.

For example, the fourth flow path 434 may be connected to the second control box 900 through the second duct connecting hole 913.

For example, the fourth flow path 434 may be connected to the first control box 800. The fourth flow path 434 may be connected to an inside of the first case 810. The fourth flow path 434 may connect the inside of the first case 810 to the duct outlet 420. The fourth flow path 434 may discharge heat generated in the first control box 800 through the duct outlet 420. The fourth flow path 434 may discharge a refrigerant gas flowed into the first case 810 through the duct outlet 420.

For example, the fourth flow path 434 may be connected to the first control box 800 through the first duct connecting hole 813 and the first control box connecting hole 401*a*.

The fourth flow path 434 may be partitioned from the first flow path 431, the second flow path 432, and the third flow path 433 described above. Particularly, the duct 400 may include a flow path partitioning wall 460 that partitions the fourth flow path 434 from the second flow path 432 and the third flow path 433.

For example, the fourth flow path 434 may include a first part 434*a* extending along the first direction Z, and a second part 434*b* extending from the first part 434*a* along the third direction Y. For example, the second part 434*b* of the fourth flow path 434 may extend from one end of the first part 434*a* of the fourth flow path 434 in the first direction Z. As shown in the drawings, the second part 434*b* of the fourth flow path 434 may extend from an upper end of the first part 434*a* of the fourth flow path 434.

In this case, the second part 434*b* of the fourth flow path 434 may be positioned in the first direction Z with respect to the second flow path 432. Also, the second part 434*b* of the fourth flow path 434 may be positioned in the second direction X with respect to the third flow path 433. The second part 434*b* of the fourth flow path 434 may flow along the third direction Y in parallel to the second flow path 432 and the third flow path 433.

Figure 15:
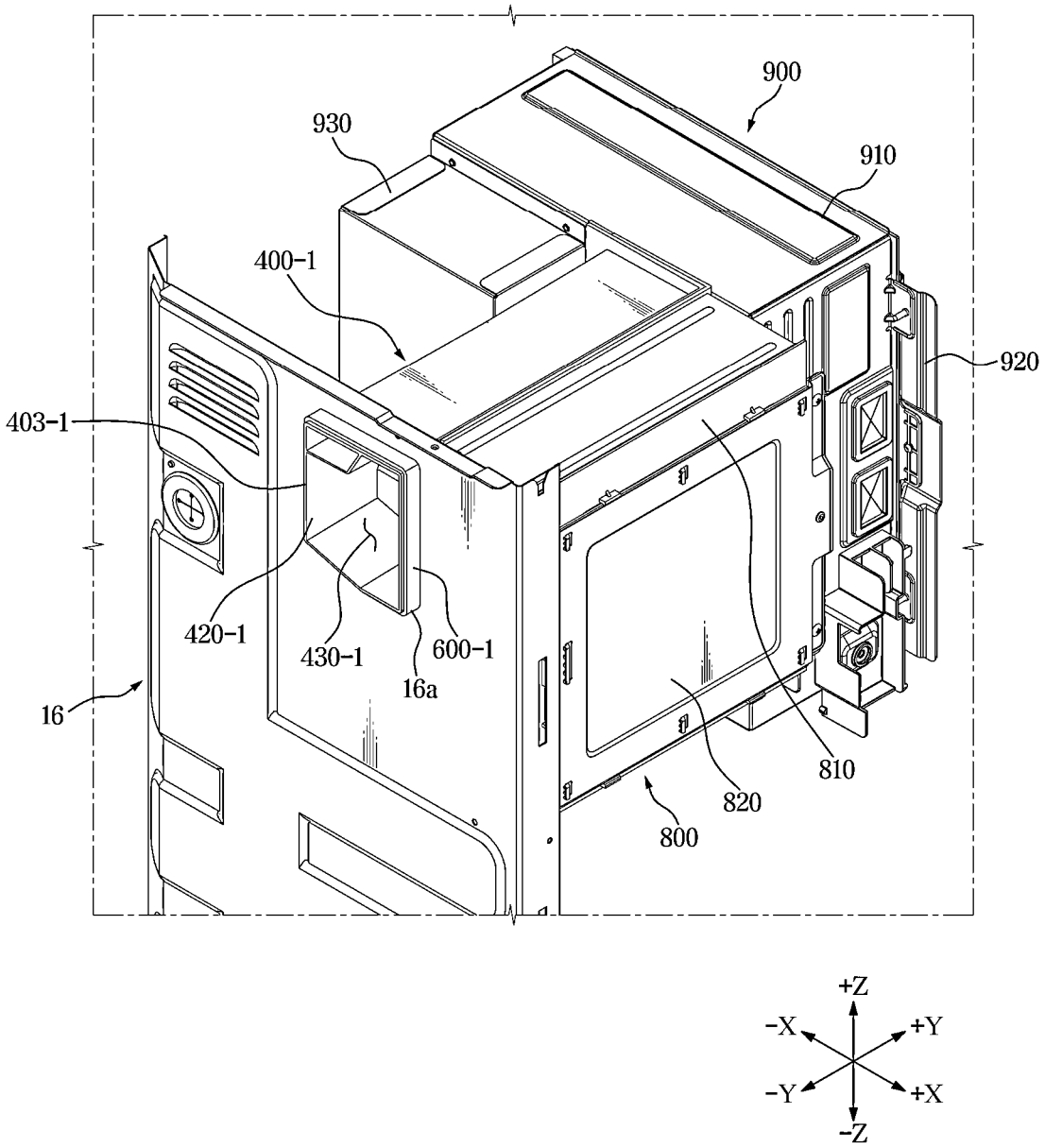
FIG. 15 is a partial perspective view illustrating various components including a control box, a duct, and a partition of an outdoor unit of an air conditioner according to various embodiments.

FIG. 15 is a perspective view illustrating various components including a control box, a duct, and a partition of an outdoor unit of an air conditioner according to various embodiments.

Referring to FIG. 15, in the following description about some components of the outdoor unit 10 of the air conditioner 1 according to an embodiment of the disclosure, the same components as those of various example embodiments described with reference to FIGS. 1 to 14 will be assigned the same reference numerals, and descriptions thereof may not be repeated here.

Referring to FIG. 15, the outdoor unit 10 of the air conditioner 1 according to an embodiment of the disclosure may include a duct 400-1. The duct 400-1 shown in FIG. 15 may have a structure and characteristics corresponding to the duct 400 shown in FIGS. 1 to 14, and accordingly, a detailed description thereof may not be repeated here.

In this case, the duct 400-1 according to the embodiment shown in FIG. 15 may be directly coupled to the partition 16. That is, the outdoor unit 10 of the air conditioner 1, as shown in FIG. 15, may not include the coupling duct 500.

The duct 400-1 may be directly connected to the heat exchange room R1 through the partition opening 16*a*, and air flowing along a duct flow path 430-1 inside the duct 400-1 may be directly discharged to the heat exchange room R1 through the duct outlet 420-1 of the duct 400-1.

For example, the duct 400-1 may include the partition connecting portion 403 coupled to the partition 16. The partition connecting portion 403-1 may penetrate the partition opening 16*a*. For example, the duct outlet 420-1 may be formed inside the partition connecting portion 403.

For example, the outdoor unit 10 may include a sealing member 600-1 that seals a gap between the partition connecting portion 403 and the partition opening 16*a*.

Figure 16:
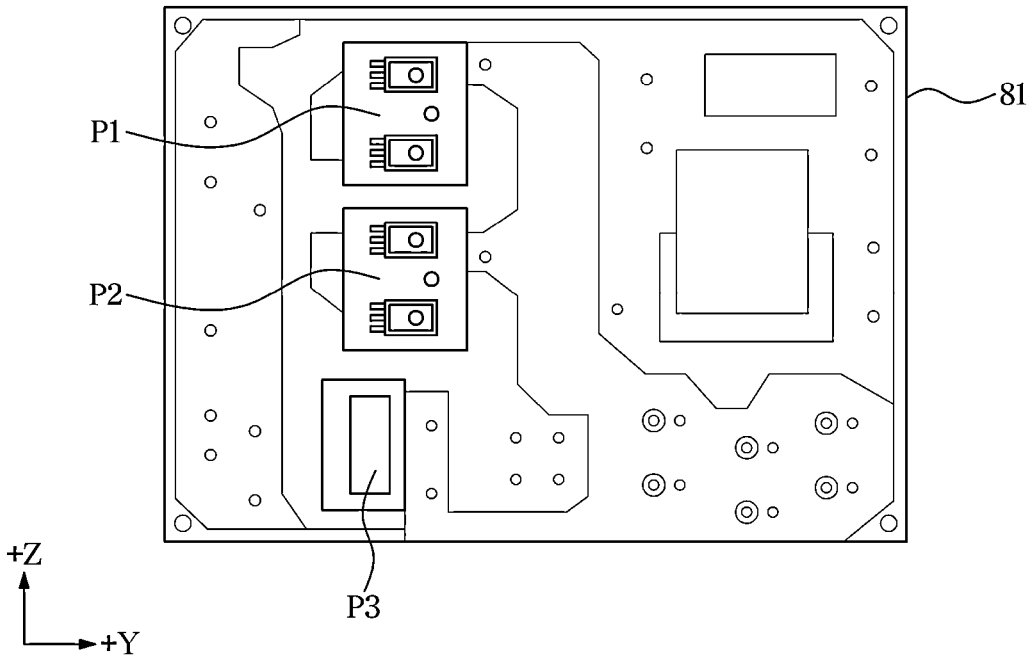
FIG. 16 is a diagram illustrating an example of a printed circuit board accommodated in a control box of an outdoor unit of an air conditioner according to various embodiments.

FIG. 16 is a diagram illustrating an example of a printed circuit board accommodated in a control box of an outdoor unit of an air conditioner according to various embodiments. FIG. 17 is a table showing experimental results obtained by measuring temperature of electronic components shown in FIG. 16 according to various embodiments.

Heat dissipation efficiency according to shapes of ducts according to various embodiments will be described in greater detail below with reference to FIGS. 16 and 17.

Referring to FIG. 16, electronic components P1, P2, and P3 (also, referred to as a first electronic component P1, a second electronic component P2, and a third electronic component P3) may be mounted on the first PCB 81 included in the outdoor unit 10 of the air conditioner 1. The first PCB 81 on which the electronic components P1, P2, and P3 are mounted may be accommodated in the first control box 800.

For example, the first electronic component P1 may be mounted on the first PCB 81. For example, the first electronic component P1 may include an Insulated-Gate Bipolar Transistor (IGBT).

The second electronic component P2 may be mounted on the first PCB 81. For example, the second electronic component P2 may include an Insulated-Gate Bipolar Transistor (IGBT).

The third electronic component P3 may be mounted on the first PCB 81. For example, the third electronic component P3 may include an Intelligent Power Module (IPM).

For example, the first PCB 81 on which the first electronic component P1, the second electronic component P2, and the third electronic component P3 are mounted may be configured with a power supply board of the outdoor unit 10.

However, kinds of the electronic components P1, P2, and P3 mounted on the first PCB 81 are not limited to these, and the first PCB 81 may include various types of PCB assemblies.

For example, the first electronic component P1, the second electronic component P2, and the third electronic component P3 may be arranged along the first direction Z. As shown in FIG. 16, the first electronic component P1 may be positioned at an upper location (+Z direction) than the second electronic component P2, and the second electronic component P2 may be positioned at an upper location (+Z direction) than the third electronic component P3.

Experimental results obtained by measuring temperature T1 of the first electronic component P1, temperature T2 of the second electronic component P2, and temperature T3 of the third electronic component P3 in three examples (e.g., 'duct shape example #1', 'duct shape example #2', and 'duct shape example #3' of FIG. 17) of shapes of the duct 400 according to the disclosure will be described with reference to FIG. 17. The structure of the duct flow path 430 may also change according to the examples of the shapes of the duct 400. In the examples, it is assumed that the heat transfer flow path 302 of the heat sink 300 extends along the first direction Z inside the duct 400.

As a first example (duct shape example #1, hereinafter, referred to as a 'duct 400 of a first shape'), the duct 400 of the first shape may include a flow path extending from the duct inlet 410 in the first direction Z, and a flow path extending toward the duct outlet 420 in the third direction Y. Inside the duct 400 of the first shape, air flowed into the duct inlet 410 may flow along the first direction Z, exchange heat with the heat sink 300, then escape from the heat sink 300, flow along the third direction Y, and be discharged to the heat exchange room R1 through the duct outlet 420.

The duct 400 of the first shape may not include the cover wall 440 (see FIG. 10) for forming the first flow path 431 (see FIG. 10) having a relatively small width in the second direction X. In other words, the duct 400 of the first shape may not include a structure for preventing/reducing air from escaping from the first part 310 of the heat sink 300.

In this case, referring to FIG. 17, in the example where the duct 400 of the first shape is applied, temperature T3 of the third electronic component P3 was measured as relatively low temperature of 76.4 degrees Celsius, whereas temperature T1 of the first electronic component P1 and temperature T2 of the second electronic component P2 were measured as relatively high temperature of 86.1 degrees Celsius and 85.0 degrees Celsius, respectively. Therefore, it is confirmed that, in the example where the duct 400 of the first shape is applied, heat dissipation efficiency of an upper portion of the heat sink 300 is relatively lower than that of a lower portion of the heat sink 300.

As a second example (duct shape example #2, hereinafter, referred to as a 'duct 400 of a second shape'), the duct 400 of the second shape may include the first flow path 431 in which the first portion 310 of the heat sink 300 is positioned and which extends from the duct inlet 410 in the first direction Z, and a second flow path 432 in which the second portion 320 of the heat sink 300 is positioned and which is positioned in the first direction Z (more specifically, the upper direction (+Z direction)) with respect to the first flow path 431 and extends along the third direction Y toward the duct outlet 420. In this case, like the structure of the duct 400 described with reference to FIGS. 1 to 15, the width of the first flow path 431 in the second direction X may be smaller than the width of the second flow path 432 in the second direction X. However, unlike the structure of the duct 400 described with reference to FIGS. 1 to 15, the duct 400 of the second shape may not include the structure of the third flow path 433 which is formed in one side of the second part 320 of the heat sink 300 in the first direction Z. In other words, in the duct 400 of the second shape, no flow path may be formed in the other end 300*b* of the heat sink 300, which is opposite to one end 300*a* of the heat sink 410 toward the duct inlet 410.

Inside the duct 400 of the second shape, air flowed into the duct inlet 410 may flow along the first flow path 431 while exchanging heat with the first portion 310 of the heat sink 300, a part of the air may escape from the heat sink 300 and flow along the second flow path 432 in the third direction Y, and another part of the air may flow to the third flow path 433 and then flow in the third direction Y. Air flowing along the second flow path 432 or the third flow path 433 may be discharged to the heat exchange room R1 through the duct outlet 420.

In this case, referring to FIG. 17, in the example where the duct 400 of the second shape is applied, temperature T1 of the first electronic component P1 and temperature T2 of the second electronic component P2 were measured as relatively low temperature of 79.3 degrees Celsius and 78.2 degrees Celsius, respectively, compared to the example where the duct 40 of the first shape is applied. Therefore, it is confirmed that, in the example where the duct 400 of the second shape is applied, heat dissipation efficiency of the upper portion of the heat sink 300 is improved compared to the example where the duct 40 of the first shape is applied.

However, referring to FIG. 17, in the example where the duct 400 of the second shape is applied, temperature T3 of the third electronic component P3 was measured as relatively high temperature of 80.8 degrees Celsius. Therefore, it is confirmed that, in the example where the duct 400 of the second shape is applied, a flow of air escaping from the first part 310 of the heat sink 300 to the outside of the heat sink 300 is blocked although air flows smoothly from the first part 310 of the heat sink 300 to the second part 310 of the heat sink 300, and accordingly, heat dissipation efficiency of the lower portion of the heat sink 300 is relatively lowered.

As a third example (duct shape example #3, hereinafter, referred to as a 'duct 400 of a third shape'), the duct 400 of the third shape may have the same structure as the duct 400 described above with reference to FIGS. 1 to 15. That is, the duct 400 of the third shape may include the first flow path 431, the second flow path 432, and the third flow path 433.

In this case, referring to FIG. 17, in the example where the duct 400 of the third shape is applied, temperature T3 of the third electronic component P3 was measured as relatively low temperature of 77.1 degrees Celsius, compared to the example where the duct 400 of the second shape is applied. Furthermore, in the example where the duct 400 of the third shape is applied, temperature T1 of the first electronic component P1 and temperature T2 of the second electronic component P2 were measured as relatively low temperature of 76.6 degrees Celsius and 75.1 degrees Celsius, respectively, compared to the example where the duct 40 of the second shape is applied. Therefore, it is confirmed that, in the example where the duct 400 of the third shape is applied, total heat dissipation efficiency of the heat sink 300 is further improved compared to the example where the duct 40 of the second shape is applied.

Figure 18:
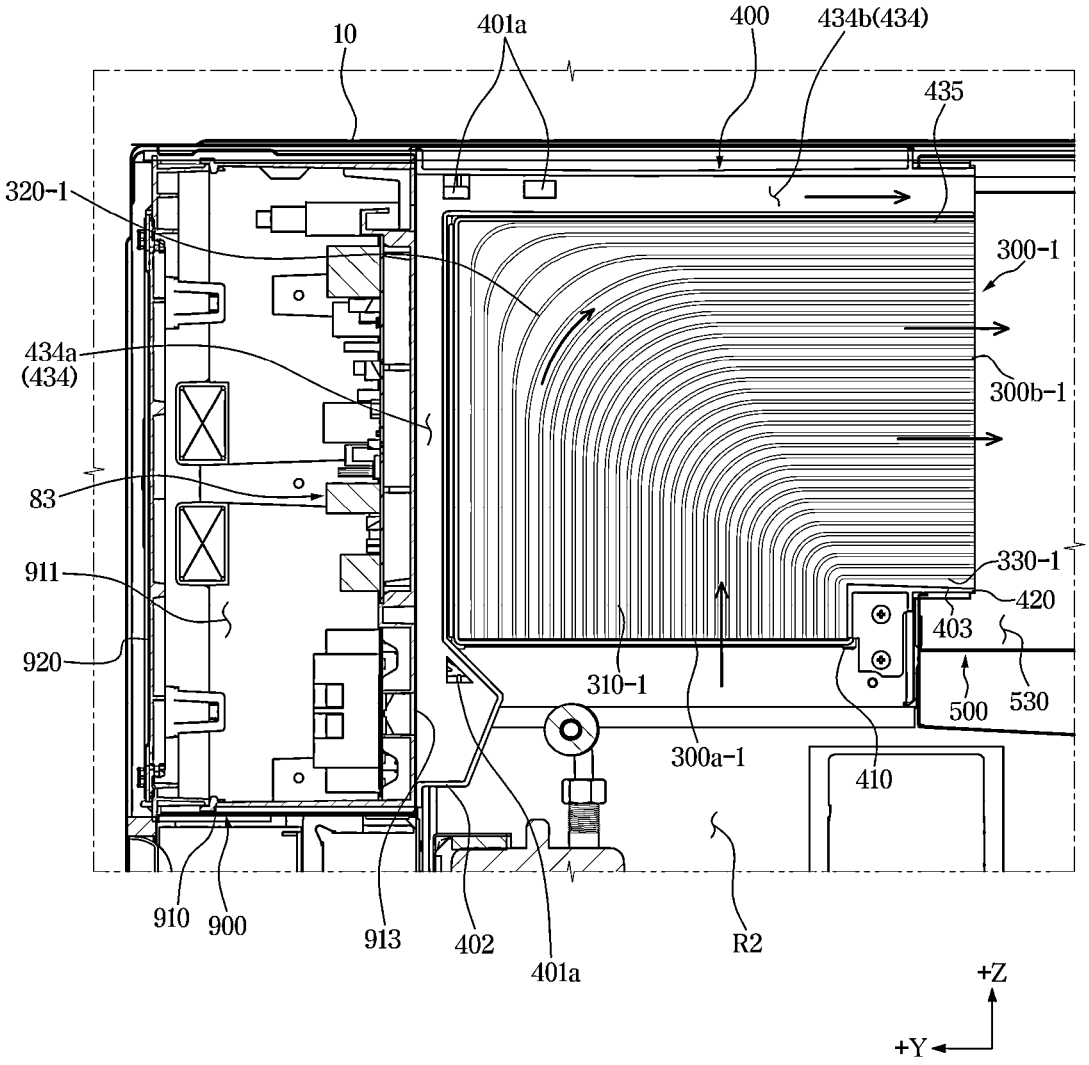
FIG. 18 is a cross-sectional view illustrating various components of an outdoor unit of an air conditioner according to various embodiments.

FIG. 18 is a cross-sectional view illustrating various components of an outdoor unit of an air conditioner according to various embodiments.

In the following description about various components included in the outdoor unit 10 of the air conditioner 1 according to an embodiment of the disclosure with reference to FIG. 18, the same components as those described with reference to FIGS. 1 to 15 will be assigned the same reference numerals, and descriptions thereof may not be repeated here.

Referring to FIG. 18, the outdoor unit 10 of the air conditioner 1 according to an embodiment of the disclosure may include a heat sink 300-1 for discharging heat generated in the first control box 800. For example, the heat sink 300-1 may discharge heat generated from the first PCB 81 and electronic components mounted thereon.

The heat sink 300-1 may be positioned inside the duct 400. The heat sink 300-1 may perform heat exchange with air flowing along the inside of the duct 400. The heat sink 300-1 may perform heat exchange with air flowing from the duct inlet 410 toward the duct outlet 420. The heat sink 300-1 may discharge heat transferred from the first control box 800 to inside air of the duct 400, and, inside the duct 400, air may flow from the duct inlet 410 to the duct outlet 420 and be discharged to the heat exchange room R1.

As described above, according to an embodiment of the disclosure, air may flow into a heat transfer flow path of the heat sink 300-1 in the first direction Z. The air may exchange heat with the heat sink 300-1, and the heat-exchanged air may flow in the third direction Y and be discharged to the heat exchange room R1.

In other words, outside air of the duct 400 may flow along the first direction Z, and flow into the inside of the duct 400 through the duct inlet 410 to arrive at the heat sink 300-1. The air may exchange heat with the heat sink 300-1, and the heat-exchanged air may flow along the third direction Y and be discharged to the heat exchange room R1 through the duct outlet 420.

According to an embodiment of the disclosure, as shown in FIG. 18, the heat sink 300-1 may include a first part 310-1 extending along the first direction Z and a second part 330-1 extending along the third direction Y. The first part 310-1 of the heat sink 300-1 may extend from one end 300*a*-1 being adjacent to the duct inlet 410 of the heat sink 300-1 along the first direction Z. The second part 330-1 of the heat sink 300-1 may extend from another end 300*b*-1 being adjacent to the duct outlet 420 of the heat sink 300-1 along the third direction Y.

In the first part 310-1 of the heat sink 300-1, air may flow along the first direction Z. In the first part 310-1 of the heat sink 300-1, air flowed from one end 300*a*-1 of the heat sink 300-1 to the first part 310-1 may flow along the first direction Z. The heat transfer flow path through which air flows in the first part 310-1 of the heat sink 300-1 may extend along the first direction Z.

In the second part 330-1 of the heat sink 300-1, air may flow along the third direction Y. In the second part 330-1 of the heat sink 300-1, air may flow along the third direction Y and be discharged through the other end 300*b*-1 of the heat sink 300-1. The heat transfer flow path through which air flows in the second part 330-1 of the heat sink 300-1 may extend along the third direction Y.

The heat sink 300-1 may include a connecting portion 320-1 connecting the first part 310-1 to the second part 330-1. The heat sink 300-1 may exchange heat with air passing through the first part 310-1, the connecting portion 320-1, and the second part 330-1 sequentially.

The connecting portion 320-1 of the heat sink 300-1 may extend in a direction that is different from extension directions of the first part 310-1 and the second part 330-1. That is, the connecting portion 320-1 of the heat sink 300-1 may change a flow direction of air from the first direction Z to the third direction Y.

For example, the connecting portion 320-1 of the heat sink 300-1 may have a bent shape to connect the first part 310-1 to the second part 330-1. For example, the connecting portion 320-1 of the heat sink 300-1 may have a curved shape.

The heat sink 300-1 may include a plurality of heat transfer plates. The plurality of heat transfer plates may be arranged in such a way as to be spaced apart from each other. A heat transfer flow path through which air flows may be formed between a pair of neighboring heat transfer plates among the plurality of heat transfer plates.

Each of the heat transfer plates of the heat sink 300-1 may include a part extending in the first direction Z, and a part extending in the third direction Y. In addition, each of the heat transfer plates of the heat sink 300-1 may include a connecting part that connects the part extending in the first direction Z to the part extending in the third direction Y and extends in a direction that is different from the first direction Z and the third direction Y.

Likewise, the heat transfer flow path of the heat sink 300-1 may include a part extending in the first direction Z and a part extending in the third direction Y. In addition, the heat transfer flow path of the heat sink 300-1 may include a connecting part that connects the part extending in the first direction Z to the part extending in the third direction Y and extends in a direction that is different from the first direction Z and the third direction Z. In the connecting part of the heat transfer flow path, a flow direction of air may change from the first direction Z to the third direction Y.

FIG. 18 shows an example in which a length of the first part 310-1 of the heat sink 300-1 in the first direction Z is shorter than a length of the second part 330-1 of the heat sink 300-1 in the third direction Y. However, a length of the first part 310-1 in the first direction Z may be longer than a length of the second part 330-1 in the third direction Y, or a length of the first part 310-1 in the first direction Z may be substantially equal to a length of the second part 330-1 in the third direction Y.

As shown in FIG. 18, for the heat sink 300-1 to cover a wide area of the rear portion of the first control box 800 in the −X direction, intervals between the heat transfer plates in the connecting portion 320-1 of the heat sink 300-1 may be wider than those between the heat transfer plates in the other parts, although not limited thereto. However, the plurality of heat transfer plates may be arranged at constant intervals throughout the heat sink 300-1.

The heat sink 300-1 may have various shapes according to the shape of the first control box 800, the shape of the duct 400, an internal structure of the machine room R2, etc.

By this configuration, air exchanged heat with the heat sink 300-1 may be discharged to the heat exchange room R1 and air may flow into the heat sink 300 in the first direction Z. Accordingly, a width of the outdoor unit 10 in the third direction Y may be reduced.

By applying the shape of the heat sink 300-1 according to an embodiment of the disclosure, the duct 400 may not have a complicated structure forming the first flow path 431, the second flow path 432, and the third flow path 433 as in the above-described embodiment, and a flow path structure for discharging heat to the heat exchange room R1 may be more simplified. In addition, using the simplified structure of the duct 400, the machine room R2 may secure a wide free space.

Additionally, a heat sink according to an example of the disclosure may be positioned such that heat transfer flow paths extend in the horizontal direction Y. For example, the heat sink may include a plurality of heat transfer plates extending in the second direction X from the side of the first PCB 81, the plurality of heat transfer plates may be arranged along the first direction Z, and a heat transfer flow path extending in the third direction Y may be formed between the plurality of heat transfer plates. Air may flow in the third direction Y, exchange heat with the heat sink, and then be discharged to the heat exchange room R1. In this case, a space through which air flows into the heat sink may be provided between the heat sink and the second control box 900.

An outdoor unit of an air conditioner according to an example embodiment of the disclosure may include: a housing including a heat exchange room and a machine room, a partition configured to partition the heat exchange room from the machine room and including a partition opening, a fan positioned in the heat exchange room, a control box positioned in the machine room and configured to accommodate a printed circuit board, a heat sink configured to discharge heat generated in the printed circuit board to outside of the control box and extending along a first direction, and a duct configured to discharge heat transferred from the heat sink to the heat exchange room. At least a part of the heat sink may be positioned inside the duct. The duct may include a duct inlet configured to introduce/move air into inside of the duct, a duct outlet connected to the partition opening and configured to discharge air to the heat exchange room, a first flow path extending from the duct inlet in the first direction along a first part of the heat sink, the first part of the heat sink being adjacent to the duct inlet, and a second flow path connecting the first flow path to the duct outlet, wherein a second part of the heat sink extending from the first part of the heat sink in the first direction, is positioned in the second flow path. A width of the second flow path in a second direction different from the first direction may be greater than a width of the first flow path in the second direction.

The second flow path may extend toward the duct outlet along a third direction different form the first direction and the second direction.

The first direction, the second direction, and the third direction may be orthogonal to each other.

The duct may further include a third flow path provided in the first direction from one side of the heat sink, opposite to the duct inlet.

A width of the third flow path in the second direction may be less than a width of the second flow path in the second direction.

The second flow path may include a first part positioned between the first flow path and the third flow path in the first direction, and a second part positioned to one side of the first part of the second flow path in the second direction.

The duct may further include a flow path guide configured to guide air inside the third flow path to flow from the third flow path toward the second flow path.

The flow path guide may be inclined to become closer to the second flow path in the first direction and being more distant from the third flow path in the second direction.

The third flow path may extend toward the duct outlet in a third direction different from the first direction and the second direction.

The printed circuit board may include a first printed circuit board, the control box may include a first control box, and the outdoor unit of the air conditioner may further include a second control box positioned in the machine room and configured to accommodate second printed circuit boards. The duct may further include a fourth flow path extending from the second control box toward the duct outlet and partitioned from the second flow path and the third flow path. At least one part of the fourth flow path may be positioned in the first direction with respect to the second flow path and in the second direction with respect to the third flow path.

The duct may further include a cover wall covering the first part of the heat sink in the second direction.

The cover wall may include an inclined portion extending to become farther away from the heat sink in the second direction while nearing the second flow path from the first flow path in the first direction.

The duct may further include an extension wall extending from one end of the cover wall, opposite to the duct inlet, in the second direction. The second flow path may be positioned in the first direction with respect to the extension wall.

The duct may further include a connection flow path connecting the second flow path to the duct outlet. A width of the connection flow path in the first direction may be greater than a width of the second flow path in the first direction.

The heat sink may include a plurality of heat transfer plates extending in the second direction from one side adjacent to the printed circuit board. The plurality of heat transfer plates may be arranged to be spaced apart from each other along a third direction different from the first direction and the second direction. The second flow path may extend toward the duct outlet along the third direction.

An outdoor unit of an air conditioner according to an example embodiment of the disclosure may include: a heat exchange room including a heat exchanger, a machine room partitioned from the heat exchange room, a control box positioned in the machine room and configured to accommodate electronic components, a heat sink installed in the control box, and a duct including a duct inlet connected to the machine room, a duct outlet connected to the heat exchange room, and a duct flow path positioned between the duct inlet and the duct outlet and passing through the heat sink. The duct flow path may include a first flow path extending from the duct inlet in a first direction and passing through a part of the heat sink adjacent to the duct inlet, and a second flow path positioned in the first direction with respect to the first flow path and passing through another part of the heat sink. A width of the second flow path in a second direction different from the first direction may be greater than a width of the first flow path in the second direction, and the second flow path may extend toward the duct outlet along a third direction different from the first direction and the second direction.

The duct flow path may further include a third flow path extending from at least a part of the second flow path in which the another part of the heat sink is positioned, in a direction that is opposite to the first flow path.

A width of the third flow path in the second direction may increase toward the second flow path in the first direction.

The first flow path may further include a first part adjacent to the duct inlet, and a second part positioned between the first part and the second flow path, wherein a width of the second part in the second direction may increase toward the second flow path from the first part.

An outdoor unit of an air conditioner according to an example embodiment of the disclosure may include: a housing including a heat exchange room and a machine room, a partition partitioning the heat exchange room from the machine room, a fan positioned in the heat exchange room, a control box positioned in the machine room and configured to accommodate a printed circuit board, a plurality of heat transfer plates extending in a first direction from one sides being adjacent to the printed circuit board and arranged to be spaced apart from each other in a second direction different from the first direction, and a duct positioned in the machine room and connected to the heat exchange room through the partition. The duct may include a duct inlet through which air is configured to flow into inside of the duct, a duct outlet connected to the partition and configured to discharge air to the heat exchange room, and a duct flow path passing through the plurality of heat transfer plates between the duct inlet and the duct outlet. The duct flow path may include a first flow path extending from the duct inlet in a third direction different from the first direction and the second direction, along a part of the plurality of heat transfer plates, adjacent to the duct inlet, and a second flow path extending along the second direction such that air from the plurality of heat transfer plates is configured to flow toward the duct outlet.

According to the disclosure, the outdoor unit of the air conditioner may improve accessibility to the control boxes by the arrangement of the control boxes.

According to the disclosure, the outdoor unit of the air conditioner may improve airtightness of the control boxes by the arrangement of the control boxes.

According to disclosure, the outdoor unit of the air conditioner may improve heat dissipation efficiency by improving the shapes and structures (for example, widths) of the duct flow paths.

According to the disclosure, the outdoor unit of the air conditioner may improve internal space efficiency of the product and achieve miniaturization of the product to the control box by the position of the heat sink and the shapes of the duct flow paths.

However, effects according to the disclosure are not limited to the above-mentioned effects, and other effects not mentioned will be clearly understood by one of ordinary skill in the technical field to which the disclosure belongs from the following descriptions.

While the disclosure has been illustrated and describe with reference to various example embodiments, it will be understood that the various example embodiments are intended to be illustrative, not limiting. It will be further understood by those skilled in the art that various modifications can be made art without departing from the true spirit and full scope of the disclosure including the appended claims and their equivalents. It will also be understood that any of the embodiment(s) described herein may be used in conjunction with any other embodiment(s) described herein.

What is claimed is:

1. An outdoor unit of an air conditioner, comprising:

a housing including a heat exchange room and a machine room;

a partition configured to partition the heat exchange room from the machine room and including a partition opening;

a fan positioned in the heat exchange room;

a control box positioned in the machine room and configured to accommodate a printed circuit board;

a heat sink configured to discharge heat generated in the printed circuit board to outside of the control box and extending along a first direction; and a duct positioned inside the machine room and configured to discharge heat transferred from the heat sink to the heat exchange room, wherein at least a part of the heat sink is positioned inside the duct, the duct comprises:

a duct inlet configured to introduce air into inside of the duct;

a duct outlet connected to the partition opening and configured to discharge air to the heat exchange room;

a first flow path formed inside the duct and extending from the duct inlet in the first direction along a first part of the heat sink, the first part of the heat sink being adjacent to the duct inlet and positioned in the first flow path; and a second flow path formed inside the duct and connecting the first flow path to the duct outlet, wherein a second part of the heat sink is positioned in the second flow path and extends from the first part of the heat sink in the first direction, and a width of the second flow path in a second direction different from the first direction is greater than a width of the first flow path in the second direction.

2. The outdoor unit of claim 1, wherein the second flow path extends along a third direction different from the first direction and the second direction, toward the duct outlet.

3. The outdoor unit of claim 2, wherein the first direction, the second direction, and the third direction are orthogonal to each other.

4. The outdoor unit of claim 1, wherein the duct further comprises a third flow path positioned in the first direction from one side of the heat sink opposite to the duct inlet.

5. The outdoor unit of claim 4, wherein a width of the third flow path in the second direction is less than the width of the second flow path in the second direction.

6. The outdoor unit of claim 4, wherein the second flow path comprises:

a first part positioned between the first flow path and the third flow path in the first direction; and a second part positioned to one side of the first part of the second flow path in the second direction.

7. The outdoor unit of claim 4, wherein the duct further comprises a flow path guide configured to guide air inside the third flow path to flow from the third flow path toward the second flow path.

8. The outdoor unit of claim 7, wherein the flow path guide is inclined to be closer to the second flow path in the first direction and to be more distant from the third flow path in the second direction.

9. The outdoor unit of claim 4, wherein the third flow path extends toward the duct outlet along a third direction different from the first direction and the second direction.

10. The outdoor unit of claim 4, wherein the printed circuit board is a first printed circuit board, the control box is a first control box, the outdoor unit of the air conditioner further comprises a second control box positioned in the machine room and configured to accommodate a second printed circuit board, the duct further comprises a fourth flow path extending from the second control box toward the duct outlet and partitioned from the second flow path and the third flow path, and at least a part of the fourth flow path is positioned in the first direction with respect to the second flow path and positioned in the second direction with respect to the third flow path.

11. The outdoor unit of claim 1, wherein the duct further comprises a cover wall covering the first part of the heat sink in the second direction.

12. The outdoor unit of claim 11, wherein the cover wall comprises an inclined portion extending to be farther away from the heat sink in the second direction while nearing the second flow path from the first flow path in the first direction.

13. The outdoor unit of claim 11, wherein the duct further comprises an extension wall extending from one end of the cover wall, opposite to the duct inlet, in the second direction, and the second flow path is positioned in the first direction with respect to the extension wall.

14. The outdoor unit of claim 1, wherein the duct further comprises a connection flow path connecting the second flow path to the duct outlet, and a width of the connection flow path in the first direction is greater than a width of the second flow path in the first direction.

15. The outdoor unit of claim 1, wherein the heat sink includes a plurality of heat transfer plates extending in the second direction from one side adjacent to the printed circuit board, the plurality of heat transfer plates are arranged to be spaced apart from each other along a third direction different from the first direction and the second direction, and the second flow path extends toward the duct outlet along the third direction.

16. An outdoor unit of an air conditioner, comprising:

a heat exchange room including a heat exchanger;

a machine room partitioned from the heat exchange room;

a control box positioned in the machine room and configured to accommodate electronic components;

a heat sink installed in the control box; and a duct positioned within the machine room, wherein the duct comprises:

a duct inlet connected to the machine room;

a duct outlet connected to the heat exchange room; and a duct flow path positioned between the duct inlet and the duct outlet and passing through the heat sink, wherein the duct flow path comprises:

a first flow path formed inside the duct and extending from the duct inlet in a first direction and passing through a part of the heat sink adjacent to the duct inlet; and a second flow path formed inside the duct and positioned in the first direction with respect to the first flow path and passing through another part of the heat sink, wherein a width of the second flow path in a second direction different from the first direction is greater than a width of the first flow path in the second direction, and wherein the second flow path extends toward the duct outlet along a third direction different from the first direction and the second direction.

17. The outdoor unit of claim 16, wherein the duct flow path further comprises:

a third flow path extending from at least a part of the second flow path in which the another part of the heat sink is positioned, in a direction that is opposite to the first flow path.

18. The outdoor unit of claim 17, wherein a width of the third flow path in the second direction increases toward the second flow path in the first direction.

19. The outdoor unit of claim 16, wherein the first flow path comprises:

a first part adjacent to the duct inlet; and a second part positioned between the first part and the second flow path, wherein a width of the second part in the second direction increases toward the second flow path from the first part.

20. An outdoor unit of an air conditioner, comprising:

a housing including a heat exchange room and a machine room;

a partition configured to partition the heat exchange room from the machine room;

a fan positioned in the heat exchange room;

a control box positioned in the machine room and configured to accommodate a printed circuit board;

a plurality of heat transfer plates extending in a first direction from one sides being adjacent to the printed circuit board and arranged to be spaced apart from each other in a second direction different from the first direction; and a duct positioned in the machine room and connected to the heat exchange room through the partition;

wherein the duct comprises:

a duct inlet through which air is configured to flow into inside of the duct;

a duct outlet connected to the partition and configured to discharge air to the heat exchange room; and a duct flow path passing through the plurality of heat transfer plates between the duct inlet and the duct outlet, wherein the duct flow path comprises:

a first flow path formed inside the duct and extending from the duct inlet in a third direction different from the first direction and the second direction, along a part of the plurality of heat transfer plates, adjacent to the duct inlet; and a second flow path formed inside the duct and extending along the second direction such that air from the plurality of heat transfer plates is configured to flow toward the duct outlet.

* * * * *